US011578495B2

(12) United States Patent
Quist et al.

(10) Patent No.: US 11,578,495 B2
(45) Date of Patent: Feb. 14, 2023

(54) SUBFLOOR JOINT

(71) Applicant: Välinge Innovation AB, Viken (SE)

(72) Inventors: Karl Quist, Höganäs (SE); Anders Nilsson, Helsingborg (SE)

(73) Assignee: VALINGE INNOVATION AB, Viken (SE)

( * ) Notice: Subject to any disclaimer, the term of this patent is extended or adjusted under 35 U.S.C. 154(b) by 45 days.

(21) Appl. No.: 16/703,280

(22) Filed: Dec. 4, 2019

(65) Prior Publication Data

US 2020/0181923 A1 Jun. 11, 2020

(30) Foreign Application Priority Data

Dec. 5, 2018 (SE) ..... 1851511-4

(51) Int. Cl.
*E04F 15/02* (2006.01)

(52) U.S. Cl.
CPC .. *E04F 15/02038* (2013.01); *E04F 15/02005* (2013.01); *E04F 15/02155* (2013.01);
(Continued)

(58) Field of Classification Search
CPC ..... E04F 15/0215; E04F 15/02155; E04F 15/02005; E04F 15/02016; E04F 15/107; E04F 15/102; E04F 2201/043; E04F 2201/0184; E04F 2201/023; E04F 2201/07; E04F 2201/0153; E04F 2201/0146; E04F 2201/0547; E04F 15/02038
See application file for complete search history.

(56) References Cited

U.S. PATENT DOCUMENTS

| | | | |
|---|---|---|---|
| 213,740 | A | 4/1879 | Connor |
| 1,124,228 | A | 1/1915 | Houston |

(Continued)

FOREIGN PATENT DOCUMENTS

| | | | |
|---|---|---|---|
| AT | 218 725 | B | 12/1961 |
| CA | 991373 | | 6/1976 |
| CA | 2 363 184 | A1 | 7/2001 |
| DE | 1 212 275 | | 3/1966 |
| DE | 2 159 042 | A1 | 6/1973 |
| DE | 2 159 042 | C3 | 6/1973 |
| DE | 26 16 077 | A1 | 10/1977 |
| DE | 30 41 781 | A1 | 6/1982 |

(Continued)

OTHER PUBLICATIONS

International Search Report and Written Opinion issued in PCT/SE2018/051321, dated Feb. 15, 2019, Patent-och registreringsverket, Stockholm SE, 12 pages.

(Continued)

*Primary Examiner* — Jessie T Fonseca
(74) *Attorney, Agent, or Firm* — Buchanan Ingersoll & Rooney P.C.

(57) ABSTRACT

A set of essentially identical subfloor panels including a joint configured to be glued, wherein the joint includes an element at a strip which protrudes from a first joint edge at an edge of a panel and an element groove at an adjacent edge. The joint includes a flexible tongue which is configured to cooperate, in the joined position, with a tongue groove for positioning of the panel relative the adjacent panel in a first vertical direction. The joint is configured for a joining of the edge and the adjacent edge by a vertical motion of the edge relative the adjacent edge. A space above the strip and between the element and the first joint edge is configured to be filled partly or completely with a glue before the edge and the adjacent edge are joined.

17 Claims, 13 Drawing Sheets

(52) U.S. Cl.
CPC . *E04F 2201/0184* (2013.01); *E04F 2201/023* (2013.01); *E04F 2201/043* (2013.01)

(56) References Cited

U.S. PATENT DOCUMENTS

| | | | |
|---|---|---|---|
| 1,371,856 | A | 3/1921 | Cade |
| 1,787,027 | A | 12/1930 | Wasleff |
| 1,898,364 | A | 2/1933 | Gynn |
| 1,925,070 | A | 8/1933 | Livezey |
| 1,988,201 | A | 1/1935 | Hall |
| 1,995,264 | A | 3/1935 | Mason |
| 2,015,813 | A | 10/1935 | Nielsen |
| 2,044,216 | A | 6/1936 | Klages |
| 2,088,238 | A | 7/1937 | Greenway |
| 2,089,075 | A | 8/1937 | Siebs |
| 2,123,409 | A | 7/1938 | Elmendorf |
| 2,303,745 | A | 12/1942 | Karreman |
| 2,387,446 | A | 10/1945 | Herz |
| 2,430,200 | A | 11/1947 | Wilson |
| 2,495,862 | A | 1/1950 | Osborn |
| 2,740,167 | A | 4/1956 | Rowley |
| 2,805,852 | A | 9/1957 | Ewert |
| 2,894,292 | A | 7/1959 | Gramelspacher |
| 2,928,456 | A | 3/1960 | Potchen et al. |
| 3,200,553 | A | 8/1965 | Frashour |
| 3,204,380 | A | 9/1965 | Smith et al. |
| 3,259,417 | A | 7/1966 | Chapman |
| 3,282,010 | A | 11/1966 | King |
| 3,301,147 | A | 1/1967 | Clayton |
| 3,347,048 | A | 10/1967 | Brown |
| 3,387,422 | A | 6/1968 | Wanzer |
| 3,436,888 | A | 4/1969 | Ottosson |
| 3,538,665 | A | 11/1970 | Gohner |
| 3,553,919 | A | 1/1971 | Omholt |
| 3,554,850 | A | 1/1971 | Kuhle |
| 3,720,027 | A | 3/1973 | Christensen |
| 3,729,368 | A | 4/1973 | Ingham |
| 3,738,404 | A | 6/1973 | Walker |
| 3,842,562 | A | 10/1974 | Daigle |
| 3,859,000 | A | 1/1975 | Webster |
| 3,927,705 | A | 12/1975 | Cromeens |
| 4,028,450 | A | 6/1977 | Gould |
| 4,169,688 | A | 10/1979 | Toshio |
| RE30,233 | E | 3/1980 | Lane et al. |
| 4,196,554 | A | 4/1980 | Anderson et al. |
| 4,426,820 | A | 1/1984 | Terbrack et al. |
| 4,471,012 | A | 9/1984 | Maxwell |
| 4,641,469 | A | 2/1987 | Wood |
| 4,819,932 | A | 4/1989 | Trotter, Jr. |
| 4,822,440 | A | 4/1989 | Hsu et al. |
| 4,944,514 | A | 7/1990 | Suiter |
| 5,029,425 | A | 7/1991 | Bogataj |
| 5,148,850 | A | 9/1992 | Urbanick |
| 5,165,816 | A | 11/1992 | Parasin |
| 5,216,861 | A | 6/1993 | Meyerson |
| 5,253,464 | A | 10/1993 | Nilsen |
| 5,255,726 | A | 10/1993 | Hasegawa et al. |
| 5,274,979 | A | 1/1994 | Tsai |
| 5,286,545 | A | 2/1994 | Simmons, Jr. |
| 5,295,341 | A | 3/1994 | Kajiwara |
| 5,349,796 | A | 9/1994 | Meyerson |
| 5,390,457 | A | 2/1995 | Sjolander |
| 5,474,831 | A | 12/1995 | Nystrom |
| 5,496,648 | A | 3/1996 | Held |
| 5,540,025 | A | 7/1996 | Takehara et al. |
| 5,560,569 | A | 10/1996 | Schmidt |
| 5,618,602 | A | 4/1997 | Nelson |
| 5,653,099 | A | 8/1997 | Mackenzie |
| 5,671,575 | A | 9/1997 | Wu |
| 5,695,875 | A | 12/1997 | Larsson |
| 5,706,621 | A | 1/1998 | Pervan |
| 5,755,068 | A | 5/1998 | Ormiston |
| 5,768,850 | A | 6/1998 | Chen |
| 5,797,237 | A | 8/1998 | Finkell, Jr. |
| 5,860,267 | A | 1/1999 | Pervan |
| 5,900,099 | A | 5/1999 | Sweet |
| 5,925,211 | A | 7/1999 | Rakauskas |
| 5,941,047 | A | 8/1999 | Johansson |
| 6,006,486 | A | 12/1999 | Moriau et al. |
| 6,021,615 | A | 2/2000 | Brown |
| 6,023,907 | A | 2/2000 | Pervan |
| 6,029,416 | A | 2/2000 | Andersson |
| 6,101,778 | A | 8/2000 | Martensson |
| 6,134,854 | A | 10/2000 | Stanchfield |
| 6,139,945 | A | 10/2000 | Krejchi et al. |
| 6,148,884 | A | 11/2000 | Bolyard et al. |
| 6,182,410 | B1 | 2/2001 | Pervan |
| 6,205,639 | B1 | 3/2001 | Pervan |
| 6,209,278 | B1 | 4/2001 | Tychsen |
| 6,216,409 | B1 | 4/2001 | Roy et al. |
| 6,247,285 | B1 | 6/2001 | Moebus |
| 6,324,803 | B1 | 12/2001 | Pervan |
| 6,324,809 | B1 | 12/2001 | Nelson |
| 6,332,733 | B1 | 12/2001 | Hamberger et al. |
| 6,345,481 | B1 | 2/2002 | Nelson |
| 6,363,677 | B1 | 4/2002 | Chen et al. |
| 6,385,936 | B1 | 5/2002 | Schneider |
| 6,421,970 | B1 | 7/2002 | Martensson |
| 6,446,405 | B1 | 9/2002 | Pervan |
| 6,490,836 | B1 | 12/2002 | Moriau et al. |
| 6,497,079 | B1 | 12/2002 | Pletzer et al. |
| 6,505,452 | B1 | 1/2003 | Hannig et al. |
| 6,510,665 | B2 | 1/2003 | Pervan |
| 6,516,579 | B1 | 2/2003 | Pervan |
| 6,521,314 | B2 | 2/2003 | Tychsen |
| 6,532,709 | B2 | 3/2003 | Pervan |
| 6,536,178 | B1 | 3/2003 | Palsson et al. |
| 6,584,747 | B2 | 7/2003 | Kettler et al. |
| 6,591,568 | B1 | 7/2003 | Palsson |
| 6,601,359 | B2 | 8/2003 | Olofsson |
| 6,606,834 | B2 | 8/2003 | Martensson et al. |
| 6,617,009 | B1 | 9/2003 | Chen et al. |
| 6,647,689 | B2 | 11/2003 | Pletzer et al. |
| 6,647,690 | B1 | 11/2003 | Martensson |
| 6,682,254 | B1 | 1/2004 | Olofsson et al. |
| 6,695,944 | B2 | 2/2004 | Courtney |
| 6,711,869 | B2 | 3/2004 | Tychsen |
| 6,715,253 | B2 | 4/2004 | Pervan |
| 6,729,091 | B1 | 5/2004 | Martensson |
| 6,769,218 | B2 | 8/2004 | Pervan |
| 6,769,219 | B2 | 8/2004 | Schwitte et al. |
| 6,772,568 | B2 | 8/2004 | Thiers et al. |
| 6,786,019 | B2 | 9/2004 | Thiers |
| 6,804,926 | B1 | 10/2004 | Eisermann |
| 6,851,237 | B2 | 2/2005 | Niese et al. |
| 6,851,241 | B2 | 2/2005 | Pervan |
| 6,862,857 | B2 | 3/2005 | Tychsen |
| 6,874,292 | B2 | 4/2005 | Moriau et al. |
| 6,880,305 | B2 | 4/2005 | Pervan et al. |
| 6,880,307 | B2 | 4/2005 | Schwitte et al. |
| 6,898,911 | B2 | 5/2005 | Kornfalt et al. |
| 6,898,913 | B2 | 5/2005 | Pervan |
| 6,918,220 | B2 | 7/2005 | Pervan |
| 6,922,964 | B2 | 8/2005 | Pervan |
| 6,922,965 | B2 | 8/2005 | Rosenthal et al. |
| 6,955,020 | B2 | 10/2005 | Moriau et al. |
| 6,966,963 | B2 | 11/2005 | O'Connor |
| 7,003,925 | B2 | 2/2006 | Pervan |
| 7,040,068 | B2 | 5/2006 | Moriau et al. |
| 7,051,486 | B2 | 5/2006 | Pervan |
| 7,055,290 | B2 | 6/2006 | Thiers |
| 7,086,205 | B2 | 8/2006 | Pervan |
| D528,671 | S | 9/2006 | Grafenauer |
| 7,121,058 | B2 | 10/2006 | Palsson et al. |
| 7,121,059 | B2 | 10/2006 | Pervan |
| 7,127,860 | B2 | 10/2006 | Pervan et al. |
| 7,131,242 | B2 | 11/2006 | Martensson et al. |
| RE39,439 | E | 12/2006 | Pervan |
| 7,169,460 | B1 | 1/2007 | Chen |
| 7,171,791 | B2 | 2/2007 | Pervan |
| 7,251,916 | B2 | 8/2007 | Konzelmann et al. |
| 7,275,350 | B2 | 10/2007 | Pervan et al. |
| 7,328,536 | B2 | 2/2008 | Moriau et al. |
| 7,356,971 | B2 | 4/2008 | Pervan |

(56) References Cited

U.S. PATENT DOCUMENTS 7,386,963 B2 6/2008 Pervan
7,398,625 B2 7/2008 Pervan
7,441,384 B2 10/2008 Miller et al.
7,441,385 B2 10/2008 Palsson et al.
7,444,791 B1 11/2008 Pervan
7,484,338 B2 2/2009 Pervan
7,506,481 B2 3/2009 Grafenauer
7,516,588 B2 4/2009 Pervan
7,568,322 B2 8/2009 Pervan et al.
7,584,583 B2 * 9/2009 Bergelin ..... E04F 15/02172 52/588.1
7,596,920 B2 10/2009 Konstanczak
7,603,826 B1 10/2009 Moebus
7,617,651 B2 11/2009 Grafenauer
7,632,561 B2 12/2009 Thiers
7,762,293 B2 7/2010 Pervan
7,775,007 B2 8/2010 Pervan
7,779,596 B2 8/2010 Pervan
7,802,411 B2 * 9/2010 Pervan ..... E04F 15/02 52/586.2
7,823,359 B2 11/2010 Pervan
7,841,144 B2 * 11/2010 Pervan ..... E04F 15/02 52/395
7,845,133 B2 12/2010 Pervan
7,856,784 B2 12/2010 Martensson
7,856,785 B2 12/2010 Pervan
7,856,789 B2 12/2010 Eisermann
7,874,119 B2 1/2011 Pervan
7,886,497 B2 2/2011 Pervan et al.
7,913,471 B2 3/2011 Pervan
7,954,295 B2 6/2011 Pervan
8,011,155 B2 9/2011 Pervan
8,021,741 B2 9/2011 Chen et al.
8,033,075 B2 10/2011 Pervan
8,071,193 B2 12/2011 Windmoller
8,112,967 B2 * 2/2012 Pervan ..... E04F 15/02038 52/747.11
8,215,076 B2 7/2012 Pervan et al.
8,234,829 B2 8/2012 Thiers et al.
8,234,831 B2 8/2012 Pervan
8,293,058 B2 10/2012 Pervan et al.
8,336,272 B2 * 12/2012 Prager ..... E04F 15/02 52/588.1
8,353,140 B2 1/2013 Pervan et al.
8,356,452 B2 1/2013 Thiers et al.
8,429,869 B2 4/2013 Pervan
8,495,849 B2 7/2013 Pervan
8,590,253 B2 11/2013 Pervan
8,591,691 B2 11/2013 Wallin
8,613,826 B2 12/2013 Pervan et al.
8,615,955 B2 12/2013 Pervan et al.
8,658,274 B2 2/2014 Chen et al.
8,689,512 B2 4/2014 Pervan
8,733,410 B2 5/2014 Pervan
8,763,340 B2 7/2014 Pervan et al.
8,826,622 B2 9/2014 Cappelle et al.
8,869,486 B2 10/2014 Pervan
9,322,183 B2 4/2016 Pervan
9,528,276 B2 12/2016 Pervan
9,567,753 B2 2/2017 Pervan et al.
9,605,436 B2 3/2017 Pervan et al.
9,695,851 B2 7/2017 Hannig
9,816,270 B2 11/2017 Pervan et al.
9,970,199 B2 5/2018 Pervan et al.
10,138,637 B2 11/2018 Pervan
10,214,916 B2 * 2/2019 Schulte ..... E04F 15/02038
10,697,175 B2 6/2020 Pervan et al.
10,801,213 B2 10/2020 Nilsson
10,941,578 B2 3/2021 Nilsson
2002/0007608 A1 1/2002 Pervan
2002/0007609 A1 1/2002 Pervan
2002/0014047 A1 2/2002 Thiers
2002/0020127 A1 2/2002 Thiers et al.
2002/0046433 A1 4/2002 Sellman et al.
2002/0046528 A1 4/2002 Pervan et al.
2002/0056245 A1 5/2002 Thiers
2002/0083673 A1 7/2002 Kettler et al.
2002/0092263 A1 7/2002 Schulte
2002/0095894 A1 7/2002 Pervan
2002/0112429 A1 8/2002 Niese et al.
2002/0112433 A1 8/2002 Pervan
2002/0170257 A1 11/2002 McLain et al.
2002/0178673 A1 12/2002 Pervan
2002/0178674 A1 12/2002 Pervan
2002/0178682 A1 12/2002 Pervan
2003/0024200 A1 2/2003 Moriau et al.
2003/0029116 A1 2/2003 Moriau et al.
2003/0033777 A1 2/2003 Thiers et al.
2003/0033784 A1 2/2003 Pervan
2003/0079820 A1 5/2003 Palsson et al.
2003/0084636 A1 5/2003 Pervan
2003/0101674 A1 6/2003 Pervan et al.
2003/0101681 A1 6/2003 Tychsen
2003/0115812 A1 6/2003 Pervan
2003/0115821 A1 6/2003 Pervan
2003/0140478 A1 7/2003 Olofsson
2003/0154676 A1 8/2003 Schwartz
2003/0154681 A1 8/2003 Pletzer
2003/0196397 A1 10/2003 Niese et al.
2003/0196405 A1 10/2003 Pervan
2004/0016196 A1 1/2004 Pervan
2004/0031225 A1 2/2004 Fowler
2004/0035078 A1 2/2004 Pervan
2004/0068954 A1 4/2004 Martensson
2004/0107659 A1 6/2004 Glockl
2004/0123547 A1 7/2004 Grafenauer
2004/0139678 A1 * 7/2004 Pervan ..... E04F 15/02 52/578
2004/0211144 A1 10/2004 Stanchfield
2004/0241374 A1 12/2004 Thiers
2005/0016107 A1 1/2005 Rosenthal et al.
2005/0034404 A1 2/2005 Pervan
2005/0034405 A1 2/2005 Pervan
2005/0055943 A1 3/2005 Pervan
2005/0102937 A1 5/2005 Pervan
2005/0144878 A1 7/2005 Grafenauer
2005/0166502 A1 8/2005 Pervan
2005/0166514 A1 8/2005 Pervan
2005/0166516 A1 8/2005 Pervan
2005/0021081 A1 9/2005 Pervan
2005/0193677 A1 9/2005 Vogel
2005/0208255 A1 9/2005 Pervan
2005/0268570 A2 12/2005 Pervan
2006/0032168 A1 2/2006 Thiers
2006/0075713 A1 4/2006 Pervan et al.
2006/0117696 A1 6/2006 Pervan
2006/0162851 A1 7/2006 Engel
2006/0196139 A1 9/2006 Pervan
2006/0283127 A1 12/2006 Pervan
2007/0011981 A1 1/2007 Eiserman
2007/0119110 A1 5/2007 Pervan
2007/0175143 A1 8/2007 Pervan et al.
2007/0175144 A1 8/2007 Hakansson
2007/0175148 A1 8/2007 Bergelin et al.
2007/0175156 A1 * 8/2007 Pervan ..... B44C 3/123 52/582.1
2008/0000179 A1 1/2008 Pervan
2008/0000180 A1 1/2008 Pervan
2008/0000182 A1 1/2008 Pervan
2008/0000186 A1 1/2008 Pervan
2008/0000187 A1 1/2008 Pervan
2008/0000188 A1 1/2008 Pervan
2008/0000189 A1 1/2008 Pervan et al.
2008/0000194 A1 1/2008 Pervan
2008/0000417 A1 1/2008 Pervan et al.
2008/0005989 A1 1/2008 Pervan et al.
2008/0005992 A1 1/2008 Pervan
2008/0005997 A1 1/2008 Pervan
2008/0005998 A1 1/2008 Pervan
2008/0005999 A1 1/2008 Pervan
2008/0008871 A1 1/2008 Pervan
2008/0010931 A1 1/2008 Pervan

(56) References Cited

U.S. PATENT DOCUMENTS

| | | | | |
|---|---|---|---|---|
| 2008/0010937 | A1* | 1/2008 | Pervan | E04F 15/02 52/588.1 |
| 2008/0028707 | A1 | 2/2008 | Pervan | |
| 2008/0028713 | A1 | 2/2008 | Pervan | |
| 2008/0034701 | A1 | 2/2008 | Pervan | |
| 2008/0034708 | A1 | 2/2008 | Pervan | |
| 2008/0041007 | A1 | 2/2008 | Pervan et al. | |
| 2008/0041008 | A1 | 2/2008 | Pervan | |
| 2008/0060308 | A1 | 3/2008 | Pervan | |
| 2008/0066415 | A1 | 3/2008 | Pervan et al. | |
| 2008/0104921 | A1 | 5/2008 | Pervan et al. | |
| 2008/0110125 | A1 | 5/2008 | Pervan | |
| 2008/0134607 | A1 | 6/2008 | Pervan et al. | |
| 2008/0134613 | A1 | 6/2008 | Pervan et al. | |
| 2008/0134614 | A1* | 6/2008 | Pervan | E04F 15/02038 52/588.1 |
| 2008/0138560 | A1 | 6/2008 | Windmoller | |
| 2008/0168737 | A1 | 7/2008 | Pervan | |
| 2008/0172971 | A1 | 7/2008 | Pervan | |
| 2008/0241440 | A1 | 10/2008 | Bauer | |
| 2009/0151291 | A1 | 6/2009 | Pervan | |
| 2010/0083603 | A1 | 4/2010 | Goodwin | |
| 2010/0229491 | A1 | 9/2010 | Pervan | |
| 2010/0275546 | A1 | 11/2010 | Pervan | |
| 2011/0030303 | A1 | 2/2011 | Pervan et al. | |
| 2011/0041996 | A1 | 2/2011 | Pervan | |
| 2011/0072754 | A1 | 3/2011 | Pervan et al. | |
| 2011/0146188 | A1 | 6/2011 | Wallin | |
| 2011/0203214 | A1 | 8/2011 | Pervan | |
| 2011/0209430 | A1 | 9/2011 | Pervan | |
| 2011/0271631 | A1* | 11/2011 | Engstrom | E04F 15/02005 52/582.2 |
| 2011/0296780 | A1 | 12/2011 | Windmoller | |
| 2012/0018091 | A1 | 1/2012 | Sjoberg et al. | |
| 2012/0216472 | A1 | 8/2012 | Martensson | |
| 2012/0233953 | A1 | 9/2012 | Pervan et al. | |
| 2012/0266555 | A1 | 10/2012 | Cappelle | |
| 2013/0014463 | A1* | 1/2013 | Pervan | E04F 15/02038 52/588.1 |
| 2013/0014890 | A1 | 1/2013 | Pervan et al. | |
| 2013/0019555 | A1* | 1/2013 | Pervan | E04F 15/02038 52/588.1 |
| 2013/0042562 | A1* | 2/2013 | Pervan | E04B 5/02 52/582.2 |
| 2013/0042565 | A1* | 2/2013 | Pervan | E04F 15/02038 52/588.1 |
| 2013/0097959 | A1 | 4/2013 | Michel | |
| 2013/0219820 | A1 | 8/2013 | Pervan | |
| 2013/0309441 | A1 | 11/2013 | Hannig | |
| 2013/0333182 | A1 | 12/2013 | Pervan et al. | |
| 2014/0020325 | A1 | 1/2014 | Pervan | |
| 2014/0090331 | A1 | 4/2014 | Pervan et al. | |
| 2014/0115994 | A1 | 5/2014 | Pervan | |
| 2014/0250813 | A1* | 9/2014 | Nygren | E04F 15/02038 52/309.15 |
| 2014/0283466 | A1* | 9/2014 | Boo | E04F 15/107 52/105 |
| 2014/0290173 | A1* | 10/2014 | Hamberger | E04F 15/02038 52/582.2 |
| 2015/0027080 | A1 | 1/2015 | Pervan | |
| 2015/0267418 | A1 | 9/2015 | Vermeulen | |
| 2015/0330088 | A1* | 11/2015 | Derelov | E04F 13/0894 52/588.1 |
| 2016/0153200 | A1* | 6/2016 | Pervan | E04F 15/02038 52/582.2 |
| 2016/0201338 | A1 | 7/2016 | Pervan | |
| 2016/0281368 | A1 | 9/2016 | Pervan et al. | |
| 2017/0073977 | A1 | 3/2017 | Huang | |
| 2017/0254076 | A1 | 9/2017 | Pervan et al. | |
| 2017/0342725 | A1 | 11/2017 | Pervan et al. | |
| 2019/0211568 | A1 | 7/2019 | Nilsson | |
| 2020/0263439 | A1 | 8/2020 | Nilsson | |
| 2020/0284034 | A1 | 9/2020 | Pervan et al. | |
| 2021/0310256 | A1 | 10/2021 | Boo | |

FOREIGN PATENT DOCUMENTS

| | | | | |
|---|---|---|---|---|
| DE | 33 43 601 | A1 | 6/1985 | |
| DE | 35 38 538 | A1 | 5/1987 | |
| DE | 39 18 676 | A1 | 8/1990 | |
| DE | 41 30 115 | A1 | 3/1993 | |
| DE | 42 42 530 | A1 | 6/1994 | |
| DE | 299 22 649 | U1 | 3/2000 | |
| DE | 200 01 225 | U1 | 7/2000 | |
| DE | 200 13 380 | U1 | 11/2000 | |
| DE | 199 25 248 | A1 | 12/2000 | |
| DE | 203 07 580 | U1 | 7/2003 | |
| DE | 102 24 540 | A1 | 12/2003 | |
| DE | 103 16 695 | A1 | 10/2004 | |
| DE | 10 2005 039 369 | A1 | 2/2007 | |
| EP | 0 220 389 | A2 | 5/1987 | |
| EP | 0 623 724 | A1 | 11/1994 | |
| EP | 0 652 340 | A1 | 5/1995 | |
| EP | 0 849 416 | A2 | 6/1998 | |
| EP | 0 976 889 | A1 | 2/2000 | |
| EP | 1 045 083 | A1 | 10/2000 | |
| EP | 1 045 083 | B1 | 10/2002 | |
| EP | 1 317 983 | A2 | 6/2003 | |
| EP | 1 317 983 | A3 | 6/2003 | |
| EP | 1 353 023 | A2 | 10/2003 | |
| EP | 1 555 357 | A1 | 7/2005 | |
| EP | 2 516 768 | | 6/2011 | |
| FR | 1.293.043 | A | 4/1962 | |
| FR | 2.128.182 | A1 | 10/1972 | |
| FR | 2 675 174 | A1 | 10/1992 | |
| GB | 812671 | | 4/1959 | |
| GB | 1 430 423 | A | 3/1976 | |
| GB | 2117813 | | 10/1983 | |
| GB | 2 256 023 | A | 11/1992 | |
| IT | MO20090228 | A | 3/2011 | |
| JP | H01-178659 | A | 7/1989 | |
| JP | H03-169967 | A | 7/1991 | |
| JP | H06-320510 | A | 11/1994 | |
| JP | H07-180333 | A | 7/1995 | |
| JP | H07-300979 | A | 11/1995 | |
| JP | H07-310426 | A | 11/1995 | |
| JP | H08-109734 | A | 4/1996 | |
| JP | H10-219975 | A | 8/1998 | |
| JP | 2000-179137 | A | 6/2000 | |
| KR | 1996-0005785 | | 7/1996 | |
| SE | 372 051 | B | 12/1974 | |
| WO | WO 84/02155 | A1 | 6/1984 | |
| WO | WO 92/17657 | A1 | 10/1992 | |
| WO | WO 93/13280 | A1 | 7/1993 | |
| WO | WO 94/26999 | A1 | 11/1994 | |
| WO | WO 96/27719 | A1 | 9/1996 | |
| WO | WO 97/47834 | A1 | 12/1997 | |
| WO | WO 98/24994 | A1 | 6/1998 | |
| WO | WO 98/24995 | A1 | 6/1998 | |
| WO | WO 98/38401 | A1 | 9/1998 | |
| WO | WO 99/66151 | A1 | 12/1999 | |
| WO | WO 99/66152 | A1 | 12/1999 | |
| WO | WO 00/66856 | A1 | 11/2000 | |
| WO | WO 01/44669 | A2 | 6/2001 | |
| WO | WO 01/75247 | A1 | 10/2001 | |
| WO | WO 02/092342 | A1 | 11/2002 | |
| WO | WO 03/012224 | A1 | 2/2003 | |
| WO | WO 03/025307 | A1 | 3/2003 | |
| WO | WO 03/078761 | A1 | 9/2003 | |
| WO | WO 2004/108436 | A2 | 12/2004 | |
| WO | WO 2012/001503 | A1 | 1/2012 | |
| WO | WO-2013009257 | A1 * | 1/2013 | E04F 15/02038 |
| WO | WO 2015/054759 | A1 | 4/2015 | |

OTHER PUBLICATIONS

International Search Report and Written Opinion issued in PCT/SE2019/051229, dated Jan. 27, 2020, Patent-och registreringsverket, Stockholm SE, 10 pages.

Correspondence from Bütec cited during opposition procedure at EPO in DE Patent No. 3343601, including announcement of Oct. 1984 re "Das Festprogram von Bütec: Mehrzweckbühnen, tanzplatten, Schonbeläge, Tanzbelage, Bestuhlung"; letter of Nov. 7, 2001

(56) References Cited

OTHER PUBLICATIONS to Perstorp Support AB with attached brochure published Oct. 1984 and installation instructions published Nov. 1984; and letter of Nov. 19, 2001 to Perstorp Support AB, 6 pages.
Drawing Figure 25/6107 From Buetec GmbH dated Dec. 16, 1985, 1 page.

* cited by examiner

SUBFLOOR JOINT

CROSS REFERENCE TO RELATED APPLICATIONS

The present application claims the benefit of Swedish Application No. 1851511-4, filed on Dec. 5, 2018. The entire contents of Swedish Application No. 1851511-4 are hereby incorporated herein by reference in their entirety.

FIELD OF THE INVENTION

Embodiments of the present invention relate to subfloor panels comprising a joint. The panels are configured to be assembled on joists. The panels and the joists may be wood based.

BACKGROUND OF THE INVENTION

Subfloors are known comprising wood based panels, such as particle boards, comprising tongue and groove joints which are configured to be glued.

Embodiments of the present invention address a need to provide an improved subfloor and joint.

SUMMARY OF THE INVENTION

Accordingly, embodiments of the present invention preferably seek to mitigate, alleviate or eliminate one or more deficiencies, disadvantages or issues in the art, such as the above-identified, singly or in any combination by providing subfloor panels comprising a joint which enables a faster assembling of the subfloor panels.

A further object of embodiments of the invention is to provide subfloor panels with a joint with increased strength.

At least some of these and other objects and advantages that will be apparent from the description have been achieved by a first aspect of the invention including set of essentially identical subfloor panels comprising a joint configured to be glued, wherein the joint comprises a strip which protrudes from a first joint edge at an edge of a panel. The joint comprises an element groove at an underside of an adjacent edge of an adjacent panel and adjacent a second joint edge of the adjacent edge. The strip comprises an element which is configured to cooperate, in a joined position of the edge and the adjacent edge, with the element groove for positioning of the panel relative the adjacent panel in a first horizontal direction and the first joint edge is configured to cooperate with the second joint edge for positioning of the panel relative the adjacent panel in a second opposite horizontal direction. The joint comprises a flexible tongue at an outer part of the strip and a tongue groove below the element groove or a flexible tongue below the element groove and a tongue groove at an outer part of the strip. The flexible tongue is configured to cooperate, in the joined position, with the tongue groove for positioning of the panel relative the adjacent panel in a first vertical direction. The joint is configured for a joining of the edge and the adjacent edge by a vertical motion of the edge relative the adjacent edge. A space above the strip and between the element and the first joint edge is configured to be filled partly or completely with a glue before the edge and the adjacent edge are joined, and wherein the joint is configured such that during joining the glue is displaced in the joint and towards an upper surface of the panel and towards a lower surface of the panel. A flow resistance towards the lower surface is greater than a flow resistance towards the upper surface.

An advantage with the greater flow resistance towards the lower surface may be that the glue may be prevented from being displaced to the flexible tongue and the tongue groove which pay prevent a proper positioning of the panel relative the adjacent panel in a first vertical direction. A further advantage may be that the glue may be properly distributed in the joint and that a portion of the glue is displaced to the upper surface of the panel which may provide an accurate bonding of the joint when the glue has dried or hardened.

The set of panels and the joint may be configured to be joined on joists.

An element top surface of the element may be configured to cooperate, in the joined position, with a groove top surface of the locking groove for positioning of the panel relative the adjacent panel in a second vertical direction.

A first upper joint edge surface of the first joint edge may be configured to cooperate, in the joined position, with a second upper joint edge surface of the second joint edge for positioning of the panel relative the adjacent panel in a second opposite horizontal direction.

A third distance between the first upper joint edge surface and the second upper joint edge surface may be in the range of about 0.05 mm to about 0.3 mm, or in the range of about 0.1 mm to about 0.2 mm, or is about 0.15 mm.

The first joint edge may comprise a third lower joint edge surface, which is adjacent and below the first upper joint edge surface and the second joint edge may comprise a fourth lower joint edge surface, which is adjacent and below the second upper joint edge surface, wherein a fourth distance, in the joined position, between the third lower joint edge surface and fourth lower joint edge surface, may be greater than the third distance.

A cooperation area, in the joined position, between element top surface and the groove top surface may extend over a first distance and a cooperation area between the first upper joint edge surface and the second upper joint edge surface may extend over a second distance, wherein the first distance may be greater than the second distance.

A ratio between the first distance and the second distance may be in the range of about 1.2 to about 4, or about 1.5 to about 3, or is about 2.

An element side surface of the element may be configured to cooperate with an element groove side surface for positioning of the panel relative the adjacent panel in the first horizontal direction, wherein the element side surface and element groove side surface may be configured to prevent or reduce the amount of glue displaced towards the outer part of the strip.

The viscosity of the glue may be within the range of about 3000 CP to about 20,000 cP at 20° C., about 5000 to about 15,000 cP at 20° C. or is about 10,000 cP at 20° C. The viscosity may be tested according to the standards DIN EN ISO 2555 or DIN EN 12092.

The joint may comprise a lower surface adjacent the element groove which may be configured to be positioned, in a joined position, at a fifth distance from an upper surface of the strip, wherein the fifth distance may be in the range of about 0.2 mm to about 0.5 mm or preferably is about 0.3 mm.

The glue may include one or more of Poly vinyl acetate glue, MS polymer glue, Polyurethane glue, Urea-formaldehyde glue, silicone or thermoplastic rubber.

The panel and the adjacent panel may be wood based panels, such as particleboard, OSB, plywood, HDF or MDF.

A second aspect of the invention includes a set of essentially identical subfloor panels comprising a joint configured to be glued. The joint comprising a tongue at a first edge of a first panel and a tongue groove at a second edge of a second panel. The tongue and the tongue groove are configured for positioning of the first panel relative the second panel in a vertical direction. A lower lip of the tongue groove extends beyond an upper lip of the tongue groove. An element protrudes from the lower lip and an underside of the first edge comprising an element groove. The element and the element groove are configured for positioning of the first panel relative the second panel in a horizontal direction. An outer edge of the lower lip comprises a first impact surface, which is downward facing, and the first edge comprising a second impact surface, which is upward facing. The first impact surface is configured to cooperate with the second impact surface for partly absorbing a force applied at an upper surface of the first panel and/or at an upper surface of a second panel when the first and the second panel are joined by the joint and assembled on joists.

Thus, the joint solves the problem of positioning the first panel relative the second panel before the glue dries or cures and bonds the first panel to the second panel.

The impact surfaces may have the effect that the strength of the joint is improved.

A lower surface of the tongue may be configured to be positioned at a distance from an upper surface of the lower lip, in a joined position of the first and the second panel such that a glue space is obtained.

The glue space may extend essentially from the element to an outer part of the tongue.

The distance between the lower surface of the tongue and the upper surface of the lower lip may be in the range of about 0.2 mm to about 0.5 mm, preferably about 0.3 mm.

An angle between the second impact surface and a lower surface of the first panel may be in the range of about 40° to about 70°, preferably about 60°.

The first impact surface may be essentially parallel to the second impact surface.

The panels may be wood based panels, such as particleboard, OSB, plywood, HDF or MDF.

The first and the second panel may each comprise outer layers and a core layer, wherein the core layer comprises coarser particles than the outer layers, wherein the lower surface of the tongue and the upper surface of the lower lip is within the core layer, such that a stronger glue connection is obtained.

The first and the second panel may each comprise outer layers and a core layer, wherein the core layer comprises coarser particles than the outer layers, wherein an upper surface of the tongue is configured to be glued to a lower surface of the upper lip, wherein the upper surface of the tongue and lower surface of the upper lip, is within the core layer, such that a stronger glue connection is obtained.

The first impact surface and the second impact surface may be configured to be glued together.

The joint may be configured for a joining of the first edge and the second edge by an angling motion of the first panel relative the second panel.

The set of panels according to the first aspect may include the joint described in the second aspect.

BRIEF DESCRIPTION OF THE DRAWINGS

These and other aspects, features and advantages of which embodiments of the invention are capable of, will be apparent and elucidated from the following description of embodiments of the present invention, reference being made to the accompanying drawings, in which.

DESCRIPTION OF EMBODIMENTS

Figure 1A:
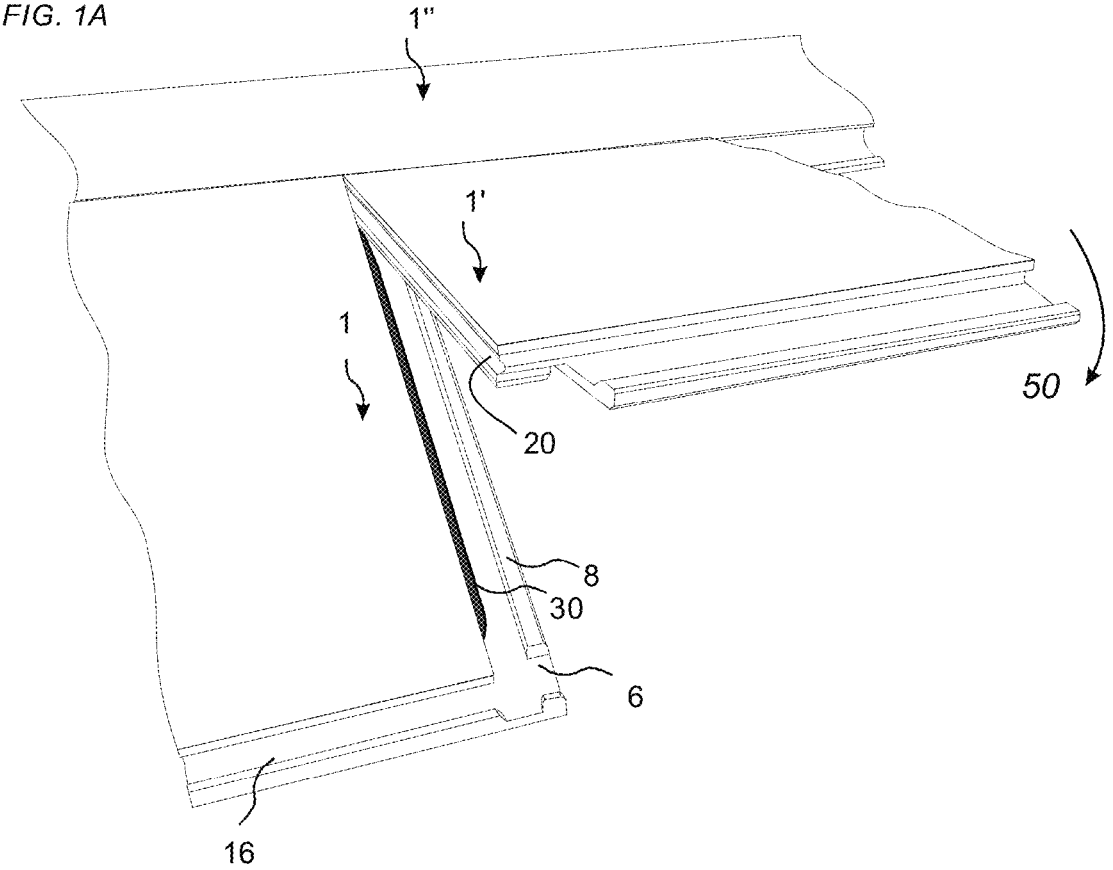
FIG. 1A shows in a 3D-view an embodiment of the set of subfloor panels according to an embodiment of the invention.

Specific embodiments of the invention will now be described with reference to the accompanying drawings. This invention may, however, be embodied in many different forms and should not be construed as limited to the embodiments set forth herein; rather, these embodiments are provided so that this disclosure will be thorough and complete, and will fully convey the scope of the invention to those skilled in the art. The terminology used in the detailed description of the embodiments illustrated in the accompanying drawings is not intended to be limiting of the invention. In the drawings, like numbers refer to like elements.

Figure 1B:
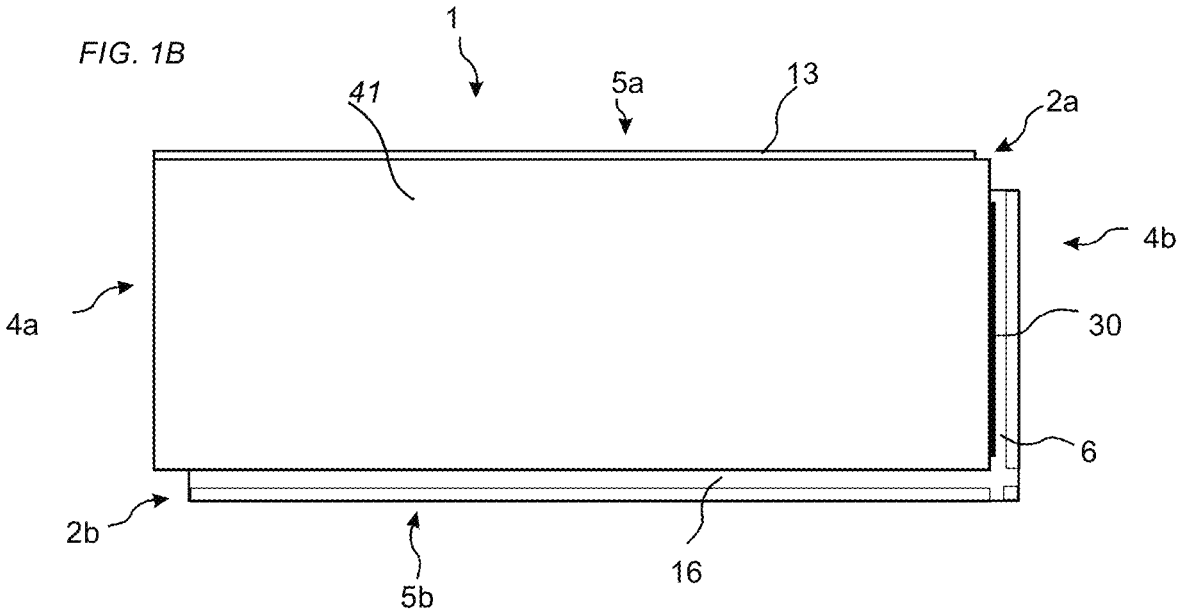
FIG. 1B shows in a top view an embodiment of a subfloor panel according to an embodiment of the invention.

An embodiment of the invention is shown in FIG. 1A in a 3D-view during assembling of a set of subfloor panels. The subfloor panels are essentially identical. An embodiment of a panel 1 in the set is shown in FIG. 1B. The panel 1 is of a rectangular shape and comprises first edge 5*a* and an opposite second edge 5*b*. The panel 1 further comprise a third edge 4*a* and an opposite fourth edge 4*b* which extend between the first edge 5*a* and the opposite second edge 5*b*. The first and the second edge may be long edges and the third and the forth edges may be short edges. The panel 1 comprises an upper surface 41 and at least two opposite edges comprise a joint for joining the panel 1 to an adjacent panel. FIG. 1A shows that a first edge 5*a* of a first panel 1' may be joined to a second edge 5*b* of a second panel 1" by an angling motion 50 and a third edge 4*a* of the first panel 1' may be joined by the same angling motion to a fourth edge 4*b* of a third panel 1. The motion to join the third edge 4*a* and the fourth edge 4*b* may be referred to as a folding motion.

Figure 2:
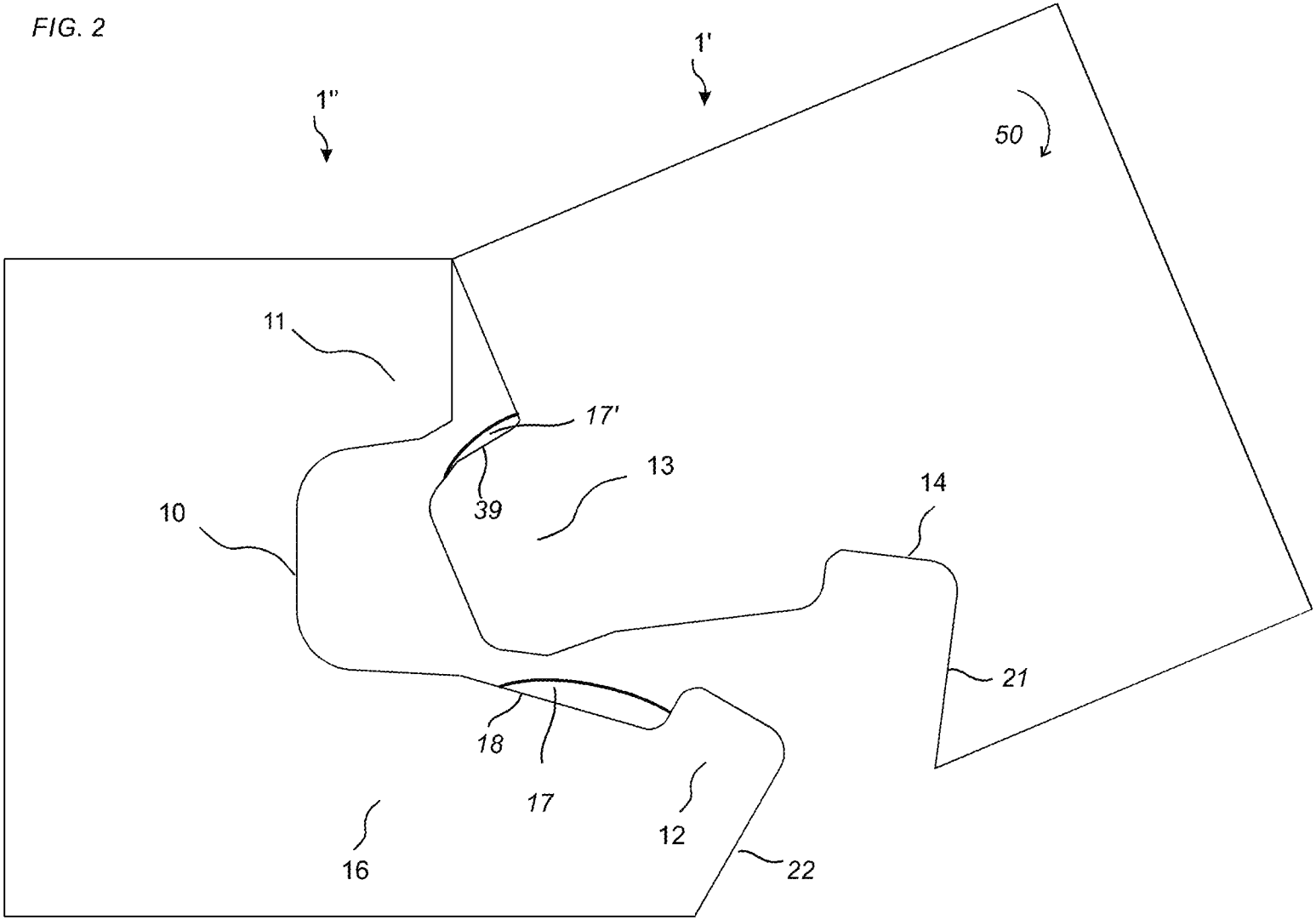
FIG. 2 shows a crosscut in a side view of an embodiment of the set of subfloor panels during joining according to an embodiment of the invention.
Figure 3:
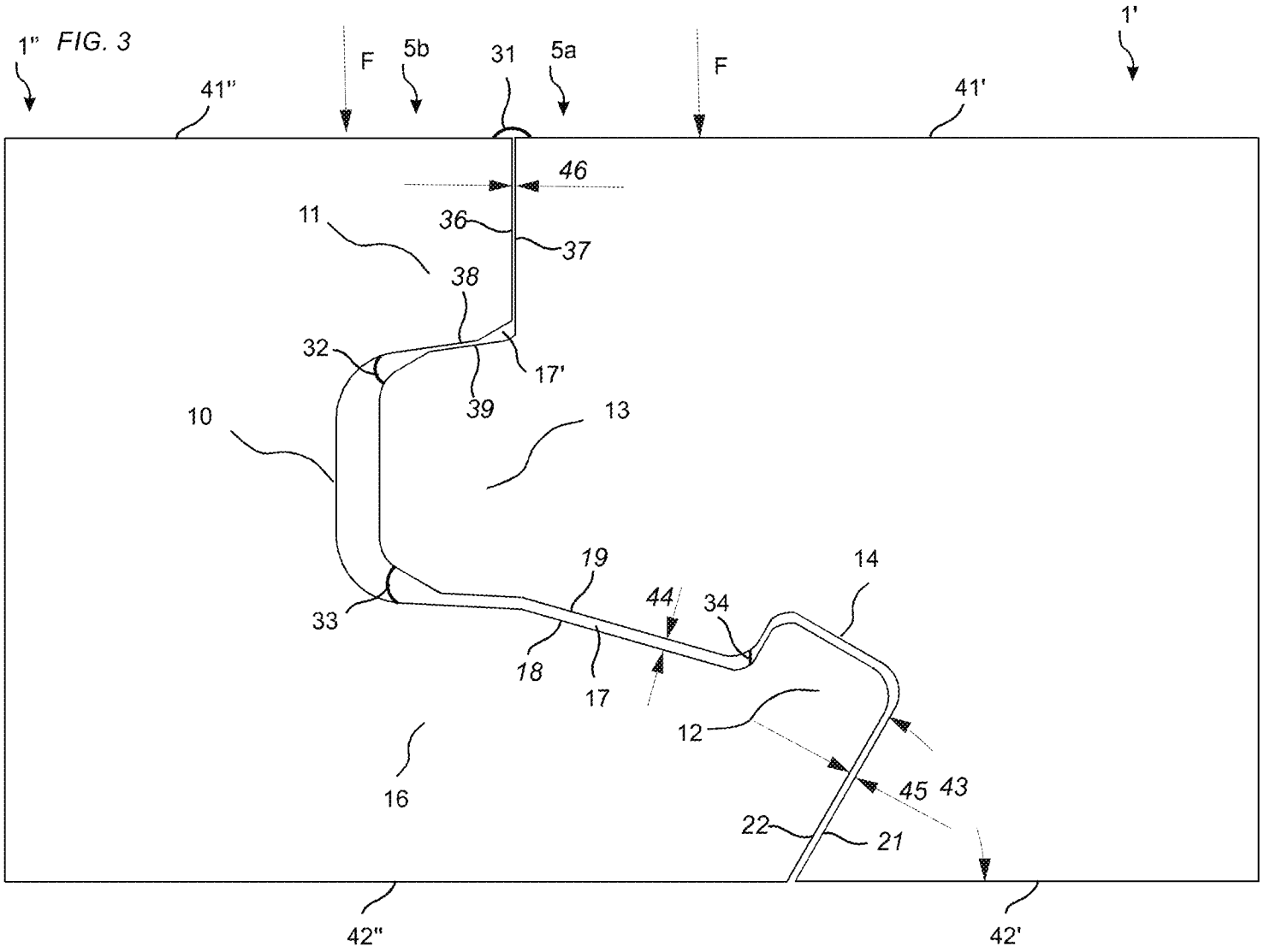
FIG. 3 shows a crosscut in a side view of an embodiment of the set of subfloor panels in a joined position according to an embodiment of the invention.
Figure 4:
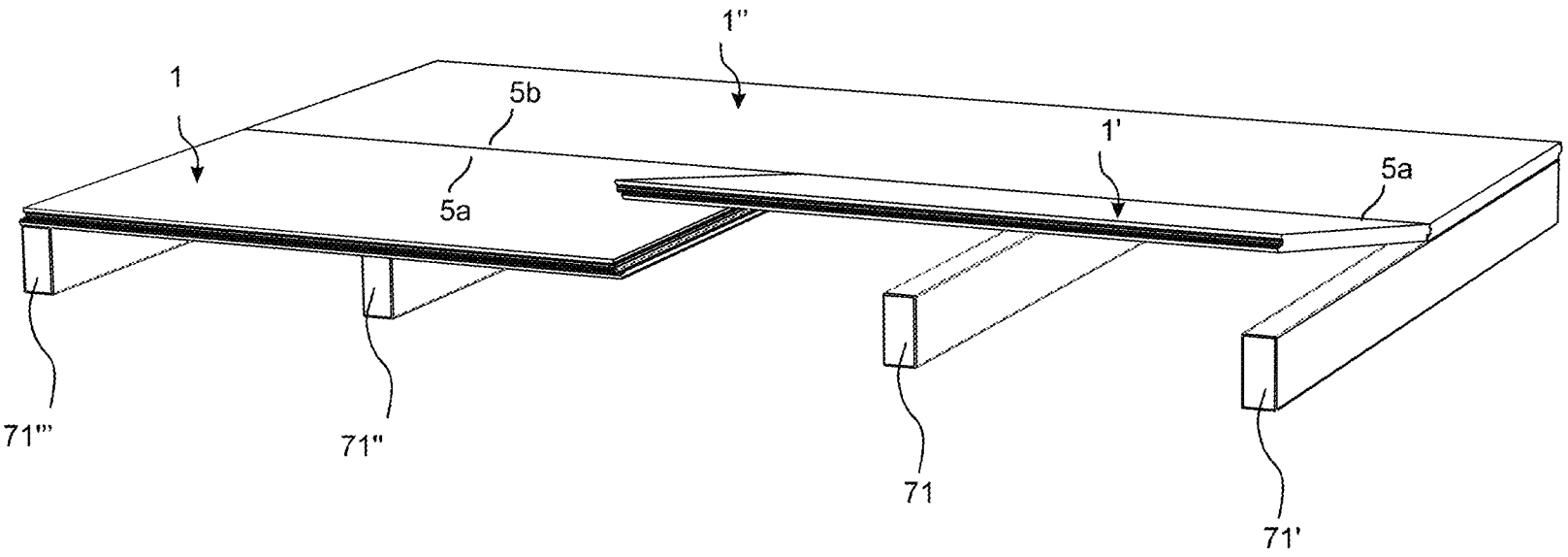
FIG. 4 shows in a 3D-view an embodiment of the set of subfloor panels during joining on joists according to an embodiment of the invention.

FIG. 2 shows a crosscut in a side view of an embodiment of the set of subfloor panels during joining and FIG. 3 the embodiment in a joined position. The set comprises a joint configured to be glued. The joint comprises a tongue 13 at a first edge 5*a* of a first panel 1' and a tongue groove 10 at a second edge 5*b* of a second panel 1". The tongue 13 and the tongue groove 10 are configured for positioning of the first panel 1' relative the second panel 1" in a vertical direction. A lower lip 16 of the tongue groove 10 extend beyond an upper lip 11 of the tongue groove 10. An element 12 protrudes from the lower lip 16 and an underside of the first edge 5*a* comprises an element groove 14, wherein the element and the element groove are configured for positioning of the first panel 1' relative the second panel 1" in a horizontal direction. An outer edge of the lower lip 16 comprises a first impact surface 22, which is downward facing, and the first edge 5*a* comprises a second impact surface 21, which is upward facing. The first impact surface 22 is configured to cooperate with the second impact surface 21 for partly absorbing a force F applied at an upper surface 41' of the first panel 1' and/or at an upper surface 41" of the second panel 1" when the first and the second panel are joined by the joint and assembled on joists 71, 71' as shown in FIG. 4.

FIG. 2 shows that glue 17, 17' may be applied on an upper surface 39 of the tongue 13 and on an upper surface 18 of the lower lip 16 before the first and the second panel are joined. Furthermore, glue may be applied on the first impact surface 22 and/or on the second impact surface 21 (not shown) before the first and the second panel are joined. The glue is during the joining distributed in parts of the joint. A portion 31 of the glue 17, 17' may be positioned, in the joined positioned, at the upper surface 41' of the first panel 1' and/or second panel. That portion of the glue is preferably removed before the glue has dried or hardened.

The glue 17' applied on the upper surface 39 of the tongue 13 may be distributed from an inner part 32 at the tip of the tongue 13 to an outer part 31 at the upper surface 41' of the first panel 1' and/or second panel 1". The glue may be applied along essentially the entire length of the edge.

The joint may comprise a first joint surface 37 at the first edge 5*a* and an opposite second joint surface 36 at the second edge 5*b*. The first joint surface 37 extends from the upper surface 41' of the first panel 1' towards the tongue 13. The second joint surface 36 extends from the upper surface 41" of the second panel 1" towards the tongue groove 10. The first joint surface 37 and the opposite second joint surface 36 are configured to be glued to each other. The glue 17' applied on the upper surface 39 of the tongue 13 may be distributed between the first joint surface 37 and the opposite second joint surface 36.

A distance 46 between the first joint surface 37 and the second joint surface 36 may be in the range of about 0.05 mm to about 0.3 mm, or in the range of about 0.1 mm to about 0.2 mm, or about 0.15 mm.

The glue 17 applied on the upper surface 18 of the lower lip 16 may be distributed from an inner part 33 at the tip of the tongue 13 to an outer part 34 at the element 12.

The glue may be a resin, preferably cross-linked, hot melt glue, white glue or glue comprising polyvinyl acetate or polyurethane.

A lower surface 19 of the tongue 13 may be configured to be positioned at a distance 44 from an upper surface 18 of the lower lip 16, in a joined position of the first and the second panel 1', 1", such that a glue space is obtained. The glue space may extend essentially from the element 12 to an outer part of the tongue 13. The distance 44 between the lower surface 19 of the tongue 13 and the upper surface 18 of the lower lip 16, may be in the range of about 0.2 mm to about 0.5 mm, preferably about 0.3 mm.

A distance between the upper surface 39 of the tongue 13 and the lower surface 38 of the upper lip 11, may be shorter than the distance 44 between the lower surface 19 of the tongue 13 and the upper surface 18 of the lower lip 16.

An angle 43 between the second impact surface and a lower surface 42' of the first panel 1' may be in the range of about 40° to about 70°, preferably about 60°.

The first impact surface 22 may be essentially parallel to the second impact surface 21.

The first impact surface 22 and the second impact surface 21 may have a planar and/or curved shape.

The first impact surface 22 and the second impact surface 21 may have the same shape.

A distance 45 between the first impact surface 22 and the second impact surface 21 may be in the range of about 0.05 mm to about 0.3 mm, or in the range of about 0.1 mm to about 0.2 mm, or about 0.15 mm.

The panels may be wood based panels, such as particleboard, OSB, plywood, HDF or MDF.

Figure 8:
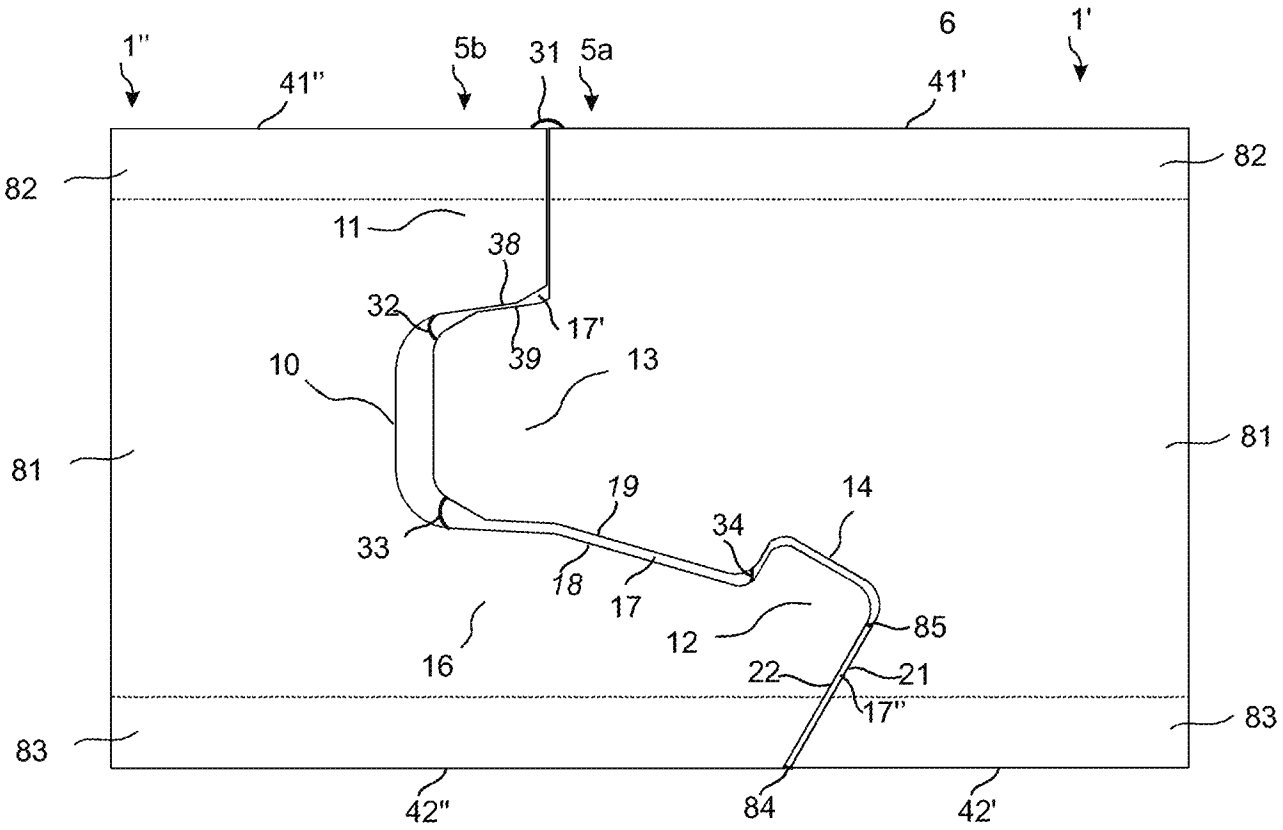
FIG. 8 shows a crosscut in a side view of an embodiment of the set of subfloor panels in a joined position according to an embodiment of the invention.

FIG. 8 shows that the first and the second panel 1', 1" each may comprise outer layers 82, 83 and a core layer 81, wherein the core layer 81 comprises coarser particles than the outer layers, wherein the lower surface 19 of the tongue and the upper surface 18 of the lower lip 16 is within the core layer, such that a stronger glue connection is obtained.

An upper surface 39 of the tongue 13 is configured to be glued to a lower surface 38 of the upper lip 11, wherein the upper surface 39 of the tongue 13 and lower surface 38 of the upper lip 11, is within the core layer 81, such that a stronger glue connection is obtained.

The first impact surface 22 may be configured to be glued to the second impact surface 21. The first impact surface 22 and the second impact surface 21 may be positioned at least partly in the core layer 81. The glue 17" between the first impact surface 22 and the second impact surface 21 may be distributed from a lower portion 84 at the lower surface 42', 42" of the first and the second panel, respectively, to an upper portion 85 adjacent an upper surface of the element groove 14.

Each of the panels may comprise a decorative layer attached to at least one of said outer layers.

FIG. 4 shows an embodiment of the first panel 1', the second panel 1" and the third panel 1 during assembling on joists 71, 71', 71", 71'". The first panel 1', the second panel 1" and the third panel 1 may be glued also to the joists 71, 71', 71", 71'". The joists 71, 71', 71", 71'" may be wood based. The first panel 1', the second panel 1" and the third panel 1 may be identical.

Figure 5A:
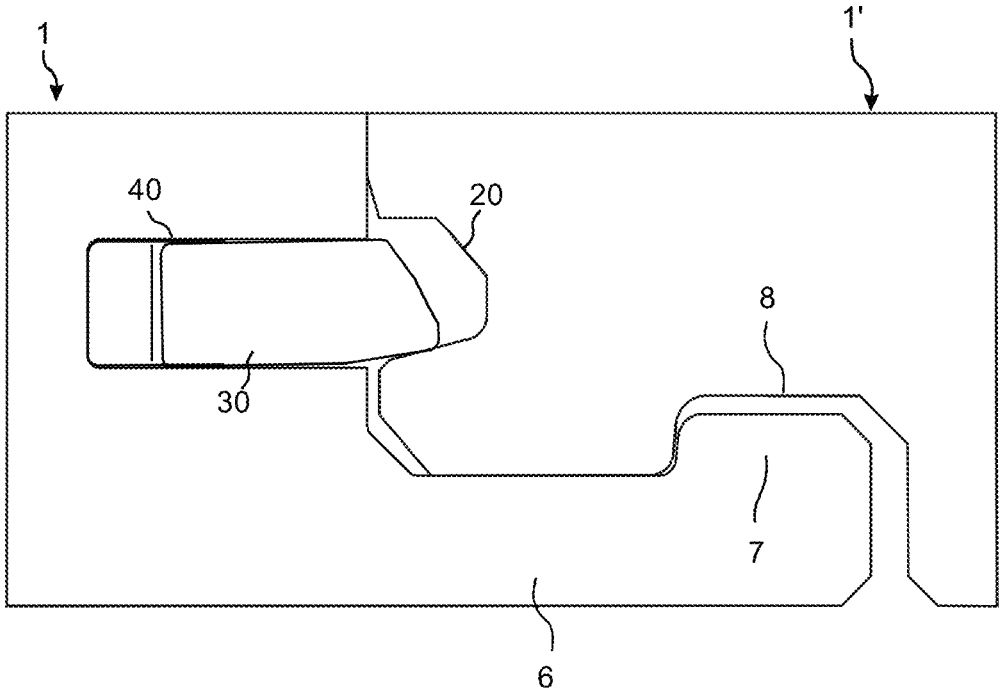
FIG. 5A-5B show crosscuts in a side view of embodiments of the set of subfloor panels in a joined position according to embodiments of the invention.
Figure 5B:
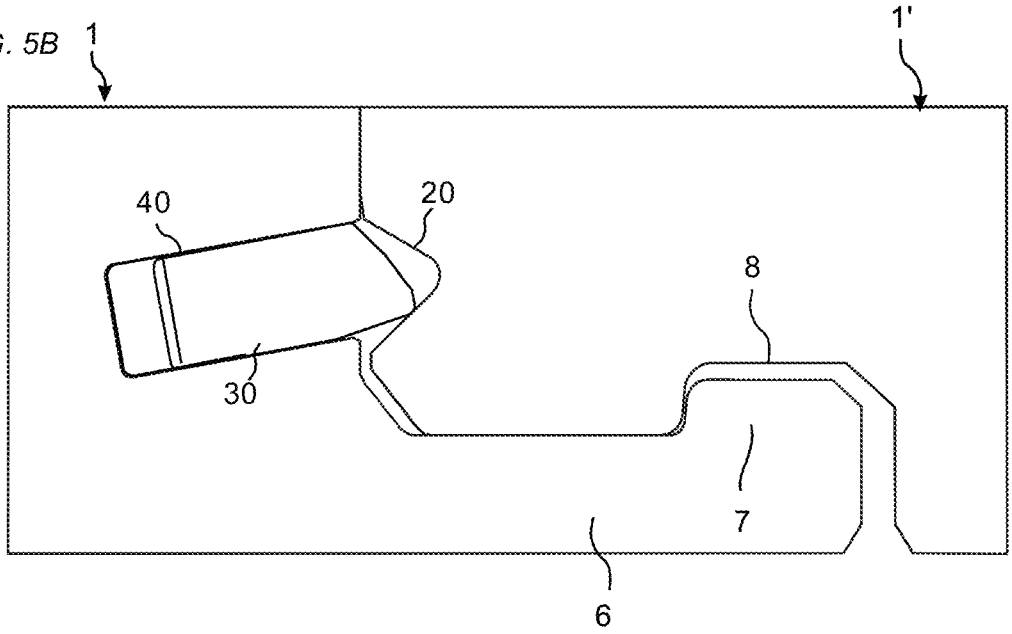

FIG. 5A shows an embodiment of the joint for joining a third edge of the first panel 1' to a fourth edge of a third panel 1. The joint may comprise a flexible tongue 30 at the fourth edge configured to cooperate with a tongue groove 20 at a third edge for positioning of the first panel 1' relative the third panel 1 in a vertical direction. The flexible tongue 30 may be positioned in a displacement groove 40. The flexible tongue may be configured to be compressed during assembling and spring back towards and partly into the tongue groove 20. The joint may comprise a strip 6 that protrudes from the fourth edge. An outer part of the strip 6 may comprise an element 7 and an underside of the third edge may comprise an element groove 8, wherein the element and the element groove are configured for positioning of the first panel 1' relative the third panel 1 in a horizontal direction. FIG. 5B shows an embodiment of the joint comprising an embodiment of the displacement groove 40 which extend in an angled direction relative an upper surface of the third panel. The angle may be from about 5 degrees to about 30 degrees, for examples from about 10 to about 20 degrees. The joint is shown in a joined position. Glue may be applied in the joint before fourth edge and the third edge are joined.

Figure 6A:
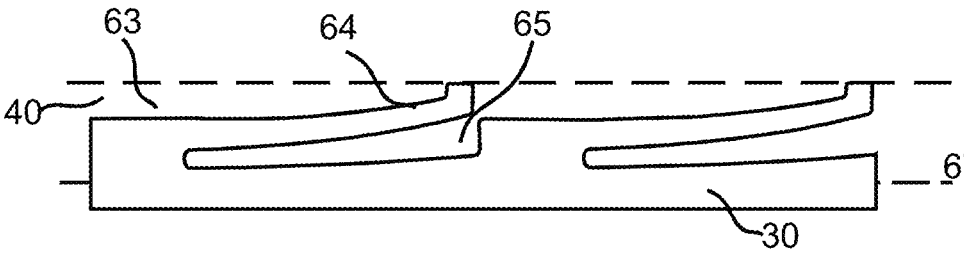
FIGS. 6A-6J show embodiments of a flexible tongue according to embodiments of the invention.
Figure 6B:
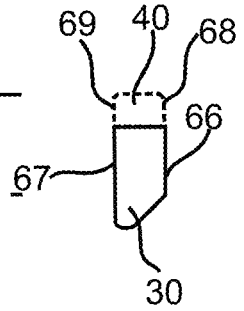
Figure 6C:
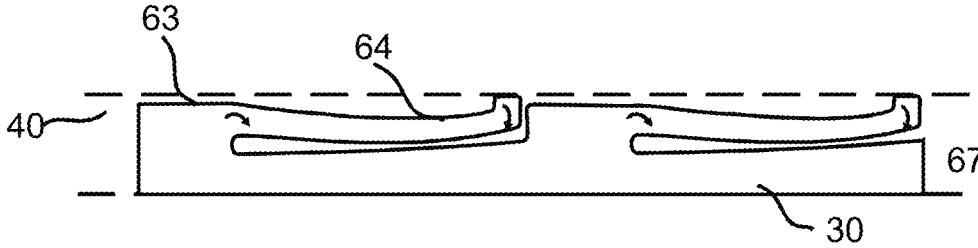
Figure 6D:
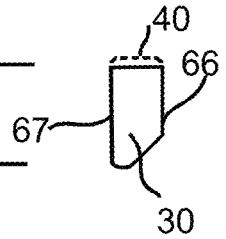

Embodiments of the flexible tongue 30, which is displaceable in the insertion groove 20, are shown in FIGS. 6A-6D. FIGS. 6A-6B show the flexible tongue 30 in a joined position and FIGS. 6C-6D show the flexible tongue 30 during assembling of a panel and an adjacent panel. FIG. 6B shows a cross section of the flexible tongue 30 in FIG. 6A, which shows a top view. FIG. 6D shows a cross section of the flexile tongue 30 in FIG. 6C, which shows a top view. The flexible tongue 30 comprises bendable protruding parts 64. A space 63 is provided between the flexible tongue 30 and a bottom wall of the insertion groove 40. FIG. 6C shows that the flexible tongue 30 is pushed into the insertion groove 40 and towards the bottom wall of the insertion groove 40 during an assembly of a panel with an adjacent panel. The flexible tongue 30 springs back towards its initial position when the panel has reached a joined position. A recess 65 is preferably arranged at each bendable protruding part.

The flexible tongue 30 may have a first displacement surface 66 and an opposite second displacement surface 67, configured to be displaced along a third displacement surface 68 and a fourth displacement surface 69, respectively, of the insertion groove 40.

Figure 6E:
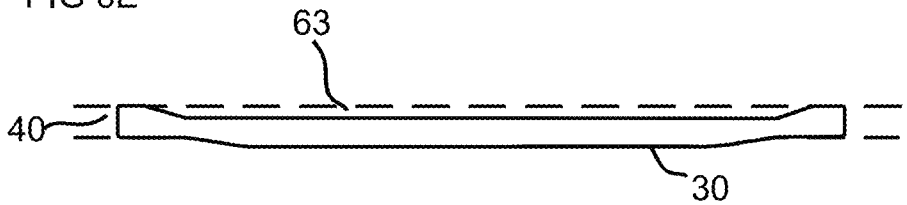
Figure 6F:
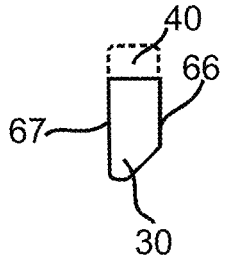

Another embodiment of the flexible tongue 30, without the protruding bendable parts 64, is shown in FIGS. 6E-6F. FIG. 6F shows a cross section of the flexible tongue 30 shown in FIG. 6E, which shows a top view. The alternative embodiment is bendable in the length direction of the flexible tongue 30 in order to accomplish a similar function as the embodiment shown in FIGS. 6A-6D.

Figure 6G:
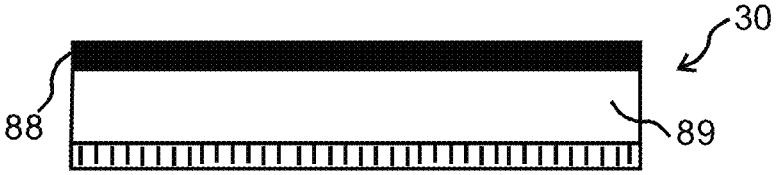

Another embodiment of the flexible tongue 30 is shown in FIG. 6G in a top view. The tongue 30 comprises an inner part 88 and an outer part 89. The inner part 88 and the outer part 89 are preferably made of two different materials, wherein the inner part 88 is more flexible than the outer part 89. The inner part 88 is configured to be inserted into the insertion groove 40 and the outer part 89 is configured to extend into the tongue groove 20.

Figure 6H:
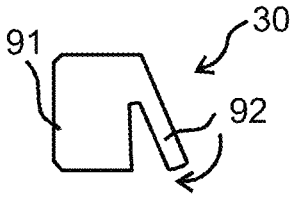
Figure 6I:
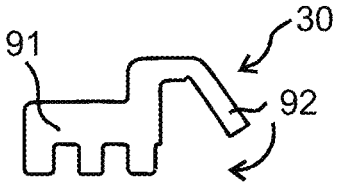
Figure 6J:
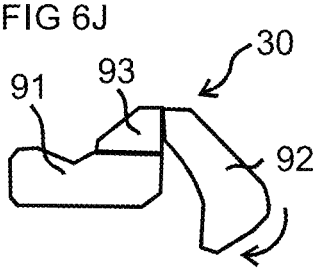

FIGS. 6G-6J show in cross section embodiments of the tongue 30 comprising an inner part 91 and a pivoting outer part 92. The inner part 91 is configured to be inserted into the insertion groove 40 and the outer part 92 is configured to extend into the tongue groove 20 and pivot during assembly of a panel and an adjacent panel. The embodiments in FIGS. 6H-61 are preferably produced in one material, such as a polymer, by extruding. The embodiment in FIG. 6J is preferably produced by coextruding and comprises at least two different polymer materials. The embodiment comprises a hinge portion 93 which connects the inner part 91 and the outer part 92. The material of the hinge portion 93 is preferably more flexible than the inner part 91 and the outer part 93.

Figure 7:
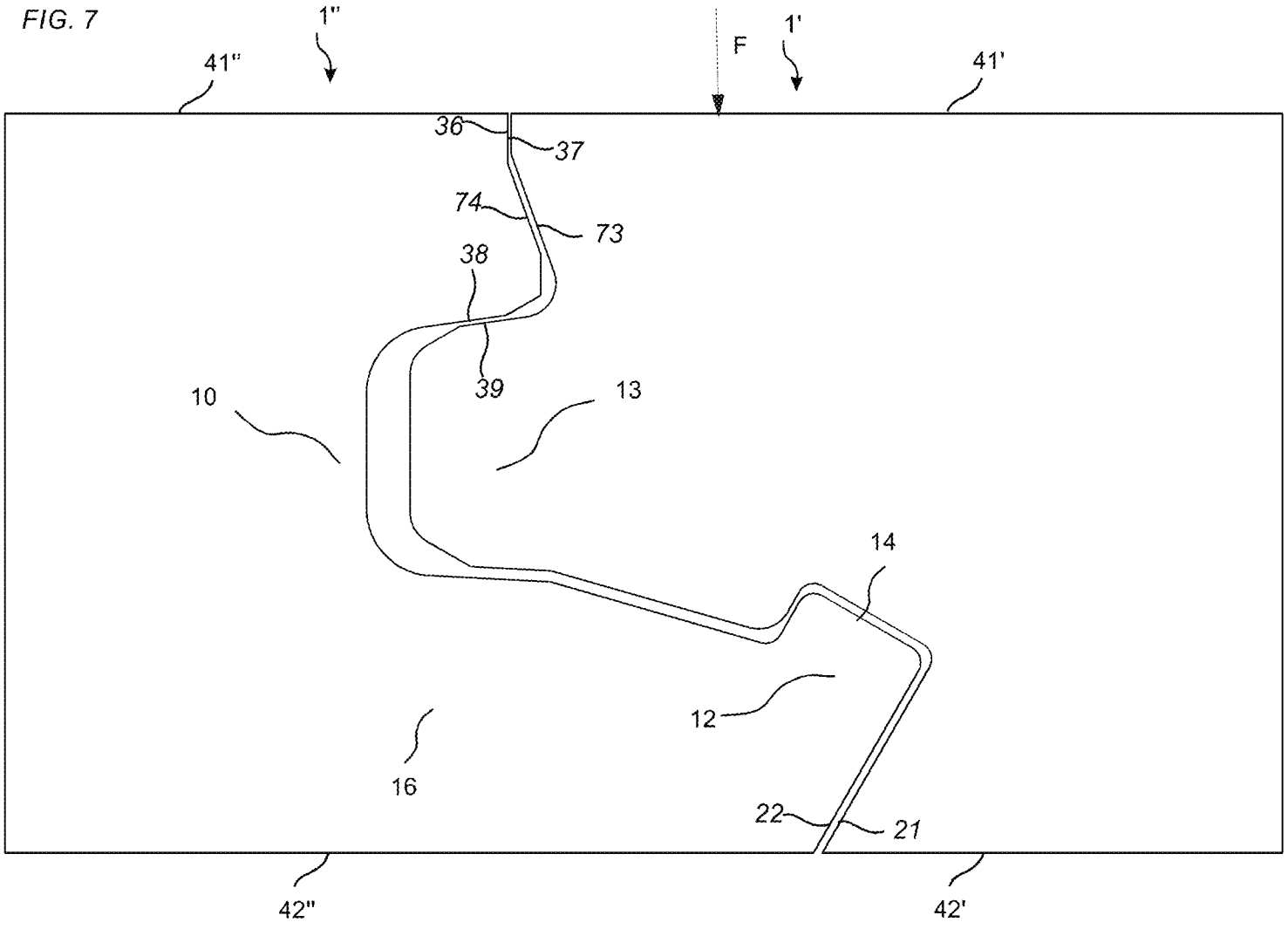
FIG. 7 shows a crosscut in a side view of an embodiment of the set of subfloor panels in a joined position according to an embodiment of the invention.

FIG. 7 shows a crosscut in a side view of an embodiment of the set of subfloor in a joined position. The set comprises a joint configured to be glued. The joint comprises at the first edge a third impact surface 73, which is downward facing, and the second edge comprising a fourth impact surface 74, which is upward facing. The third impact surface 73 is configured to cooperate with the fourth impact surface 74 for partly absorbing a force F applied at an upper surface 41' of the first panel when the first and the second panel are joined by the joint and assembled on joists 71, 71' as shown in FIG. 4. The third impact surface 73 may be positioned between the upper surface 39 of the tongue 13 and the first joint surface 37. The fourth impact surface 74 may be positioned between the upper surface 39 of the tongue 13 and the second joint surface 36.

Figure 9A:
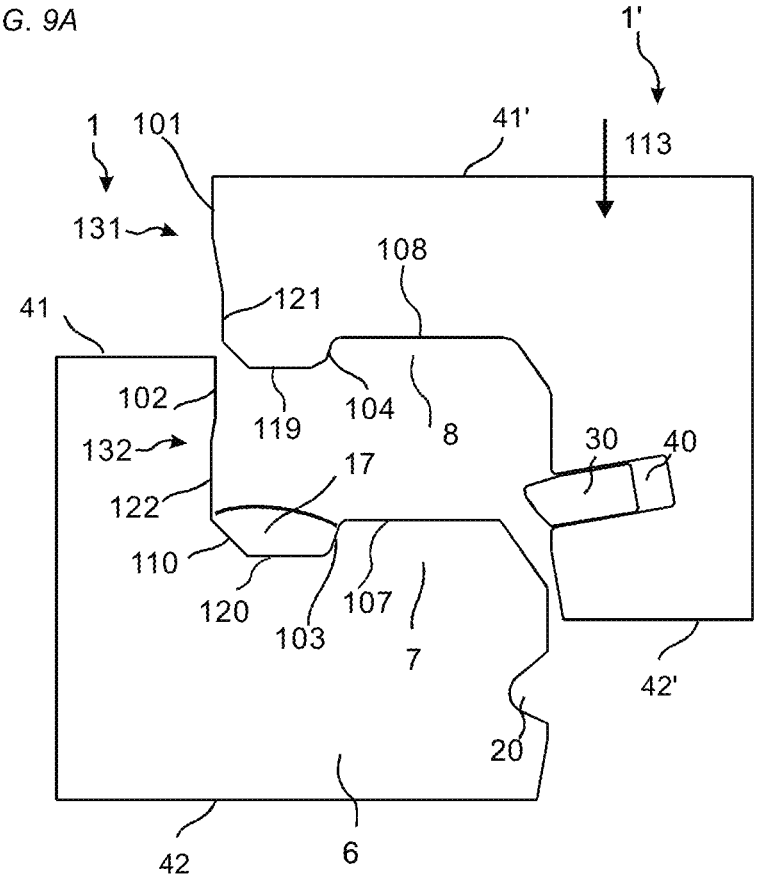
FIG. 9A-9B show crosscuts during assembling in a side view of an embodiment of the set of subfloor panels according to an embodiment of the invention.
Figure 9B:
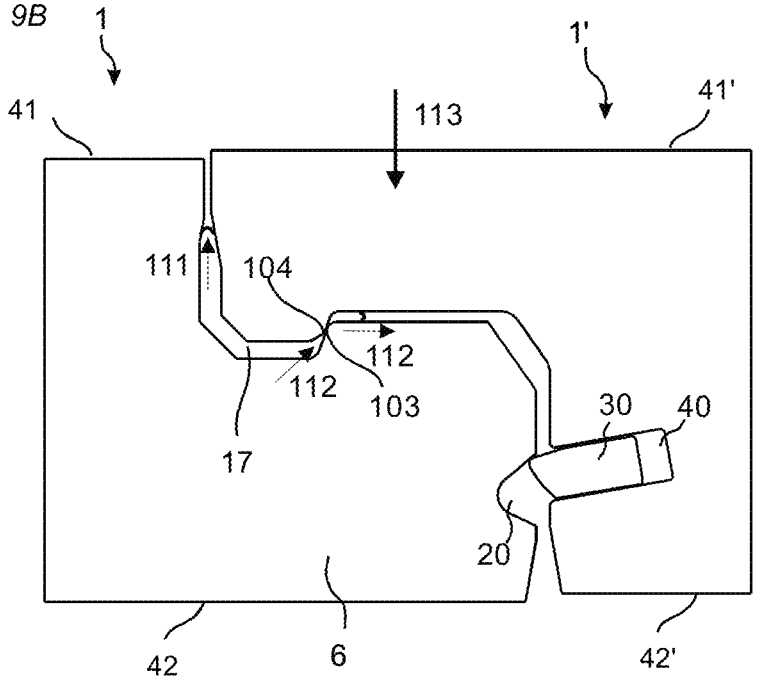
Figure 10A:
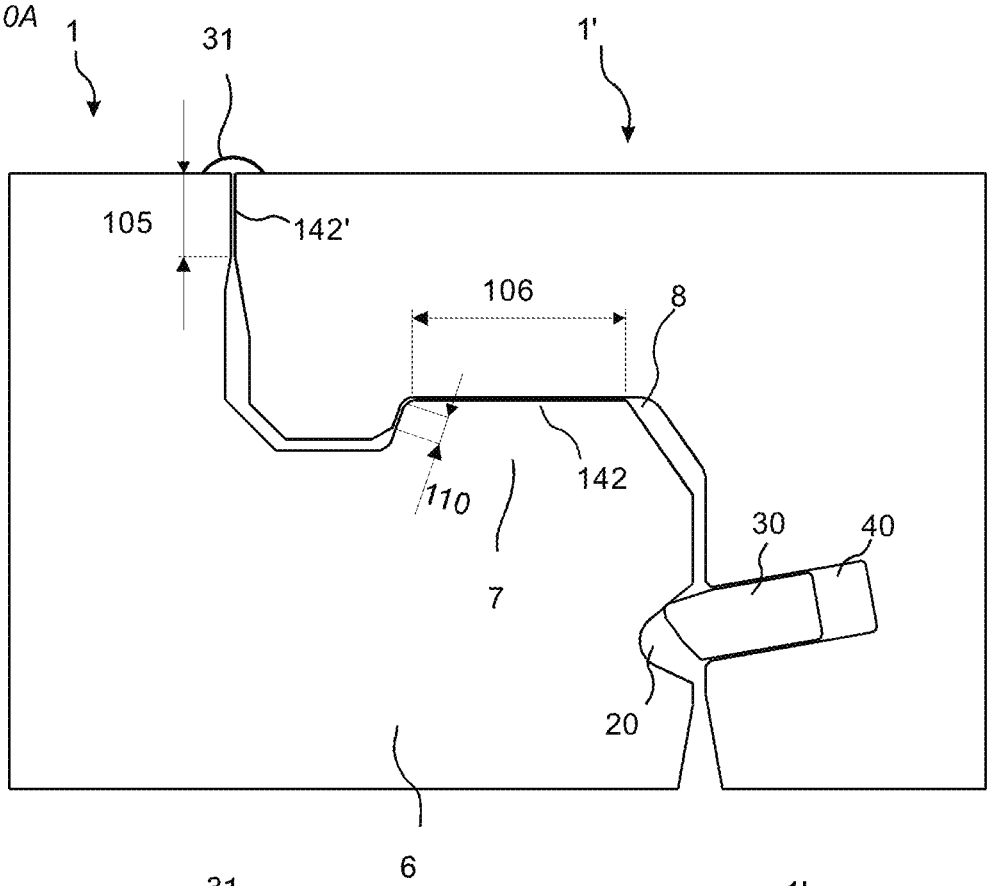
FIG. 10A-10B show crosscuts in a joined position in a side view of the embodiment shown in FIG. 9A-9B.
Figure 10B:
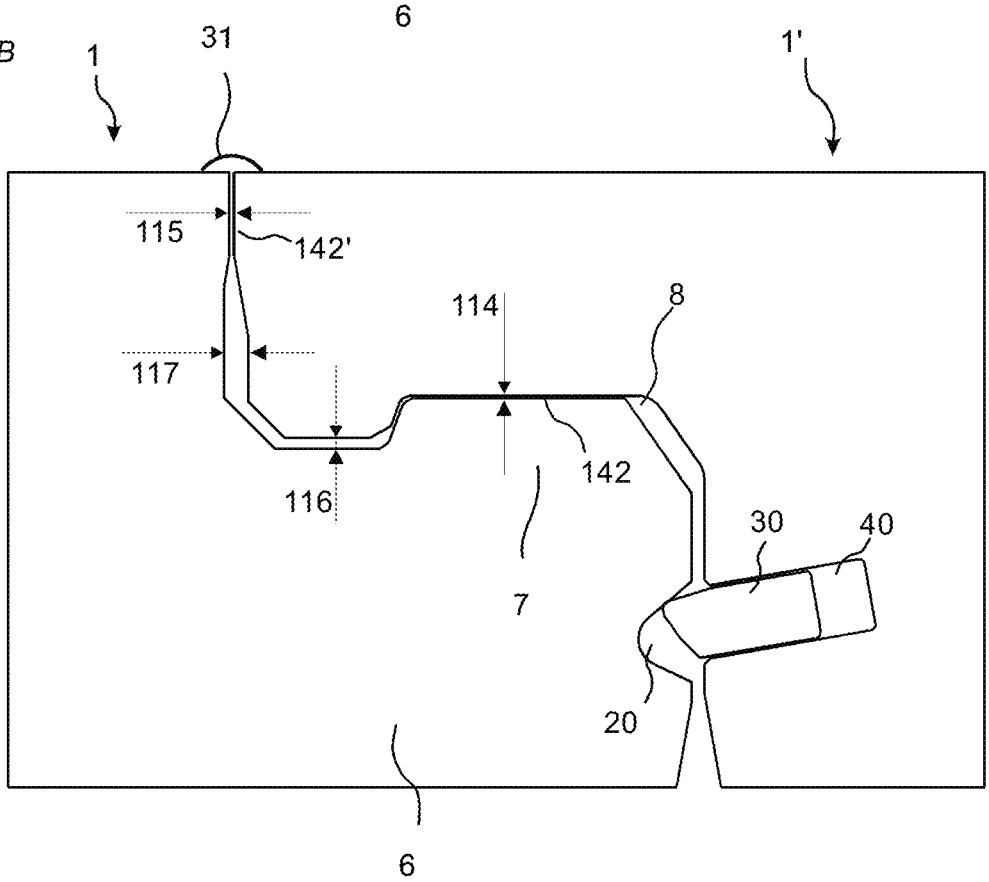
Figure 10C:
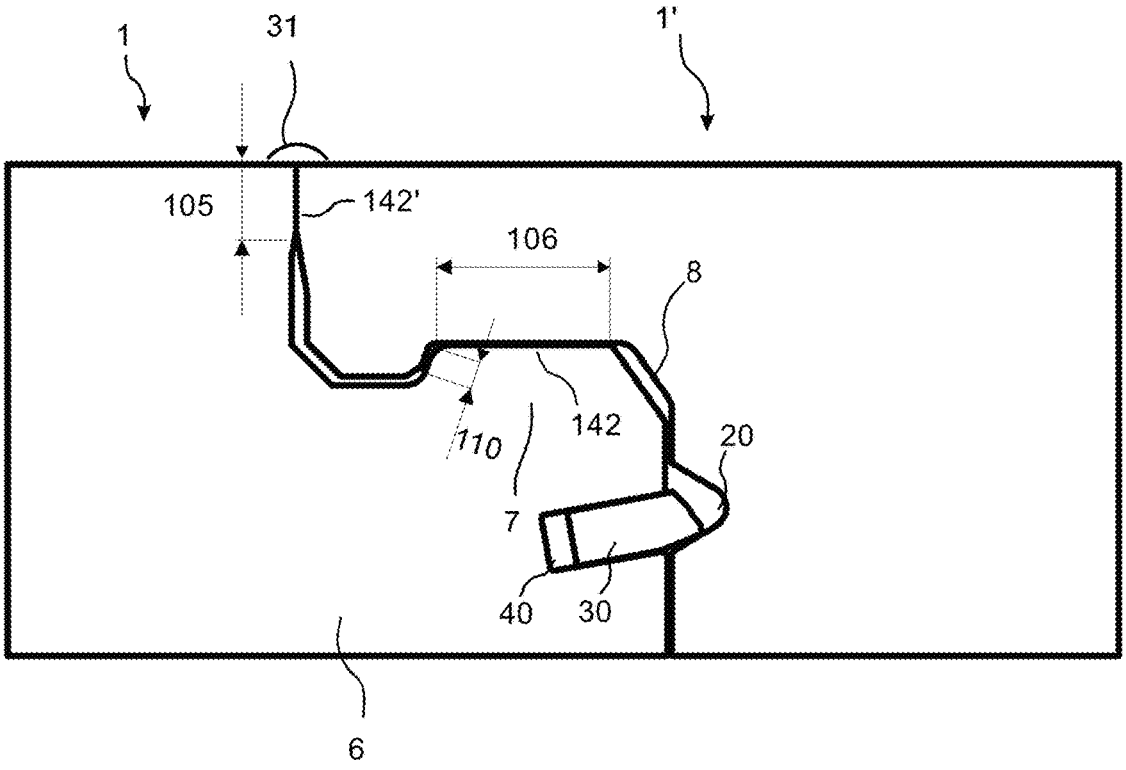
FIG. 10C shows a crosscut in a joined position in a side view of the embodiment shown in FIG. 9A-9B with an alternative arrangement of the displaceable tongue.

FIGS. 9A-9B show crosscuts during assembling in a side view of an embodiment of the set of subfloor panels and FIGS. 10A-10B show crosscuts in a joined position in a side view of the embodiment shown in FIGS. 9A-9B. The embodiment includes a set of essentially identical subfloor panels 1, 1' comprising a joint configured to be glued, wherein the joint comprises a strip 6 which protrudes from a first joint edge 132 at an edge of a panel 1. The joint comprises an element groove 8 at an underside of an adjacent edge of an adjacent panel 1' and adjacent a second joint edge 131 of the adjacent edge. The strip 6 comprise an element 7 which is configured to cooperate, in a joined position of the edge and the adjacent edge, with the element groove 8 for positioning of the panel 1 relative the adjacent panel 1' in a first horizontal direction and the first joint edge 132 is configured to cooperate with the second joint edge 131 for positioning of the panel 1 relative the adjacent panel 1' in a second opposite horizontal direction. The joint may comprise, as shown in FIG. 10C, a flexible tongue 30 at an outer part of the strip 6 and a tongue groove 20 below the element groove 8 or, as shown in FIGS. 10A-10B a flexible tongue 30 below the element groove 8 and a tongue groove 20 at an outer part of the strip. The flexible tongue 30 is configured to cooperate, in the joined position, with the tongue groove 20 for positioning of the panel 1 relative the adjacent panel 1' in a first vertical direction.

A space above the strip 6 and between the element 7 and the first joint edge 132 is configured to be filled partly or completely with a glue before the edge and the adjacent edge are joined, and wherein the joint is configured such that during joining the glue is displaced in the joint and towards 111 an upper surface 41 of the panel and towards 112 a lower surface 42 of the panel. A flow resistance towards the lower surface 42 is greater than a flow resistance towards the upper surface 41.

The joint is configured for a joining of the edge and the adjacent edge by a vertical motion 113 of the adjacent edge relative the edge.

The glue 17 may be applied on an upper surface 120 of the strip 6 before the edge and the adjacent edge are joined. The glue is during the joining distributed in parts of the joint. A portion 31 of the glue may be positioned, in the joined positioned, at the upper surface 41,41' of the panel 1 and/or the adjacent panel 1'. The portion 31 of the glue 17 may indicate that the glue is properly distributed in the joint and may provide a proper seal of the joint at the upper surface 41'. The portion 31 of the glue 17 is preferably removed before the glue has dried or hardened.

The joint may be configured such that the displacement of the glue during the joining is discontinued before the glue reaches the flexible tongue 30 and the tongue groove 20. The displacement of the glue may be discounted at an upper part of the element 7.

The joint may comprise an insertion groove 40 and the flexible tongue may be positioned in the insertion groove 40. The flexible tongue 30 may be displaceable in the insertion groove 40. Embodiments of the flexible tongue 30 are shown in FIGS. 6A-6J and described above. It may be an advantage that the glue is prevented from reaching the flexible tongue and the tongue groove since glue in the insertion groove 40 and or tongue groove may prevent a correct positioning of the panel 1 relative the adjacent panel 1' in the first vertical direction.

An element top surface 107 of the element 7 may be configured to cooperate, in the joined position, with a groove top surface 108 of the locking groove 8 for positioning of the panel 1 relative the adjacent panel 1' in a second vertical direction.

A first upper joint edge surface 102 of the first joint edge 132 may be configured to cooperate, in the joined position, with a second upper joint edge surface 101 of the second joint edge 131 for positioning of the panel 1 relative the adjacent panel 1' in a second opposite horizontal direction.

In the joined position, a third distance 115 between the first upper joint edge surface 102 and the second upper joint edge surface 101 may be in the range of about 0.05 mm to about 0.3 mm, or in the range of about 0.1 mm to about 0.2 mm, or is about 0.15 mm.

The first joint edge 132 may comprise a third lower joint edge surface 122, which is adjacent and below the first upper joint edge surface 102 and the second joint edge 131 may comprise a fourth lower joint edge surface 121, which is adjacent and below the second upper joint edge surface 101. A fourth distance 117, in the joined position, between the third lower joint edge surface 122 and fourth lower joint edge surface 12 may be greater than the third distance 115 which may reduce the flow resistance towards the upper surface 41.

A cooperation area, such as a first cooperation area 142, in the joined position, between element top surface 107 and the groove top surface 108 may extend over a first distance 106 and a cooperation area, such as a second cooperation area 142', between the first upper joint edge surface 102 and the second upper joint edge surface 101 may extend over a second distance 105, wherein the first distance 106 may be greater than the second distance 105 which may provide a greater flow resistance towards the lower surface 42 than the flow resistance towards the upper surface 41.

A ratio between the first distance 106 and the second distance 105 may be in the range of about 1.2 to about 4, or about 1.5 to about 3, or is about 2.

An element side surface 103 of the element 7 may be configured to cooperate with an element groove side surface 104 for positioning of the panel 1 relative the adjacent panel 1' in the first horizontal direction, wherein the element side surface 103 and element groove side surface 104 may be configured to prevent or reduce the amount of glue displaced towards the outer part of the strip 6.

The viscosity of the glue may be within the range of about 3000 CP to about 20,000 cP at 20° C., about 5000 to about 15,000 cP at 20° C. or is about 10,000 cP at 20° C.

The joint may comprise a lower surface 119 adjacent the element groove 8 which may be configured to be positioned, in a joined position, at a fifth distance 116 from an upper surface 120 of the strip 6, wherein the fifth distance preferably is in the range of about 0.2 mm to about 0.5 mm or preferably is about 0.3 mm The glue may include one or more of Poly vinyl acetate glue, MS polymer glue, Polyurethane glue, Urea-formaldehyde glue, silicone or thermoplastic rubber.

The panel 1 and the adjacent panel 1' may be wood based panels, such as particleboard, OSB, plywood, HDF or MDF.

The panel and the adjacent panel 1, 1' may each comprises outer layers and a core layer, wherein the core layer comprises coarser particles than the outer layers, wherein the upper surface of the strip may be within the core layer such that a stronger glue connection is obtained.

The panel 1 and the adjacent panel 1' and the joint may be configured to be joined on joists 71 as shown in FIG. 4.

The panels may be installed by the folding motion shown in FIG. 1A and described above, wherein the edge correspond to the fourth edge 4*a* and the adjacent edge corresponds to the third edge 4*b*. The panel 1, which correspond to the third panel 1, and the adjacent panel 1', which corresponds to the first panel 1', are installed in a row and may be installed to another panel 1", which correspond to the second panel", in another row.

Figure 11A:
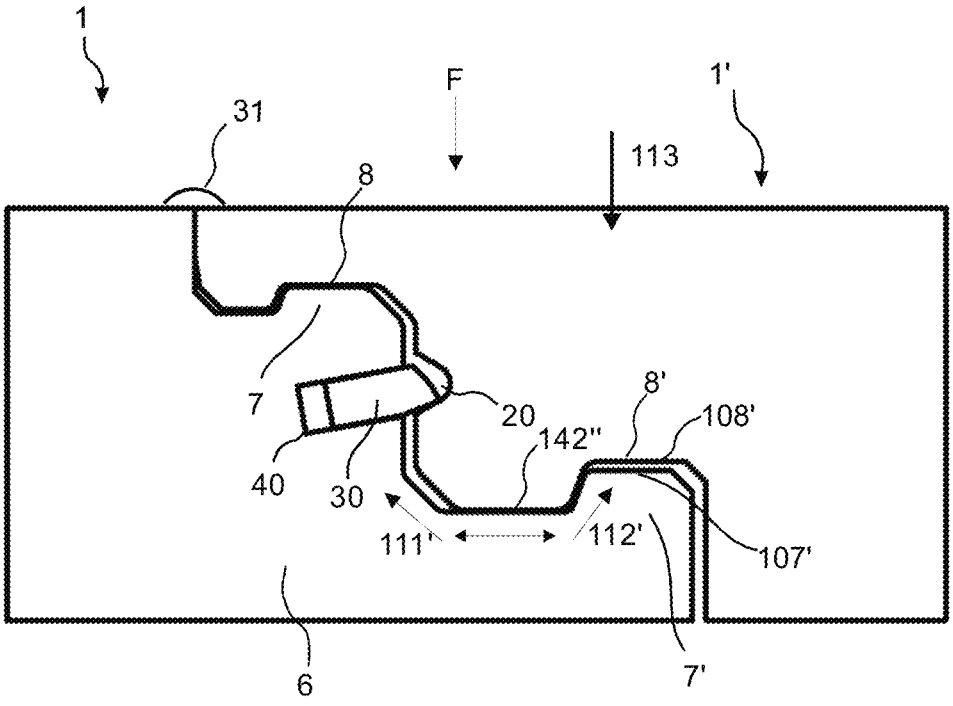
FIGS. 11A-11B show crosscuts in a joined position in a side view of an embodiment of the set of subfloor panels according to embodiments of the invention.
Figure 11B:
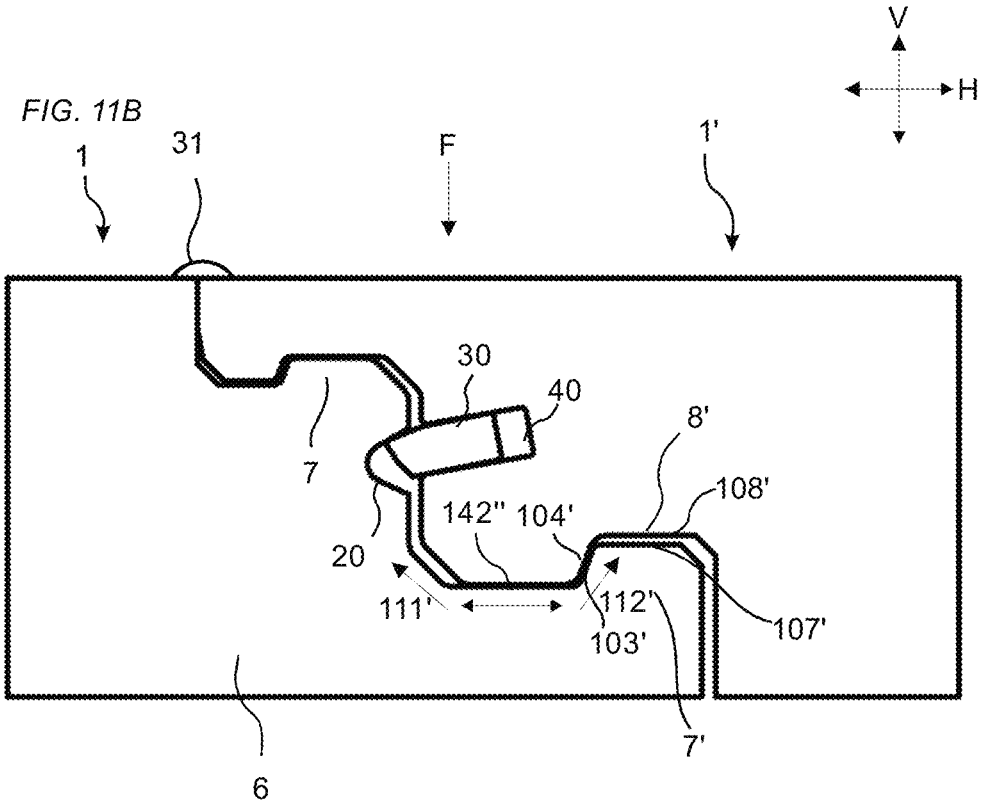
Figure 12A:
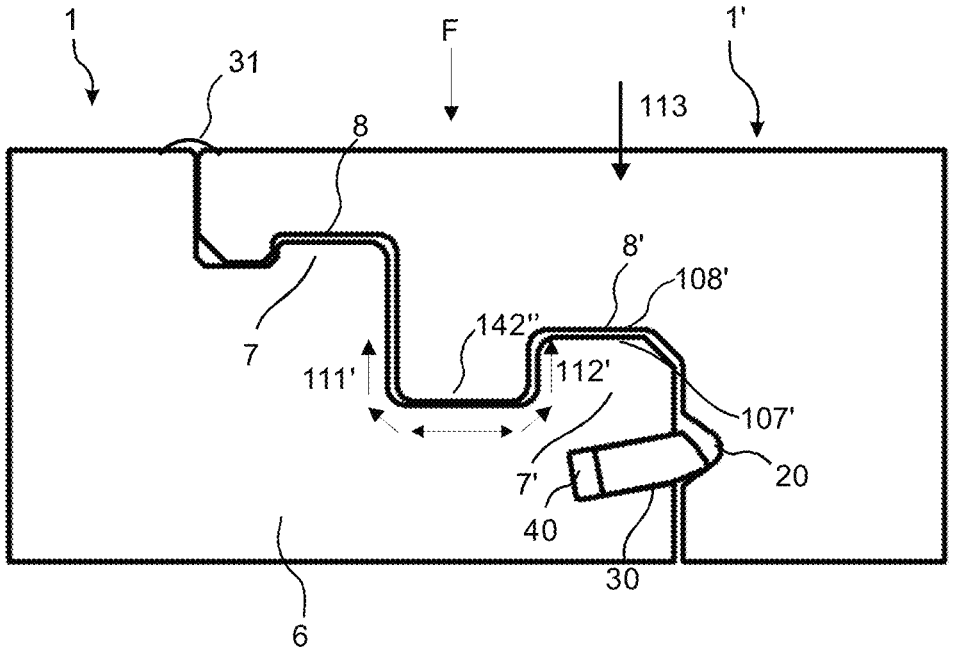
FIGS. 12A-12B show crosscuts in a joined position in a side view of an embodiment of the set of subfloor panels according to embodiments of the invention.
Figure 12B:
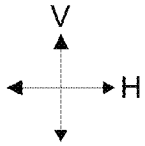
Figure 12B:
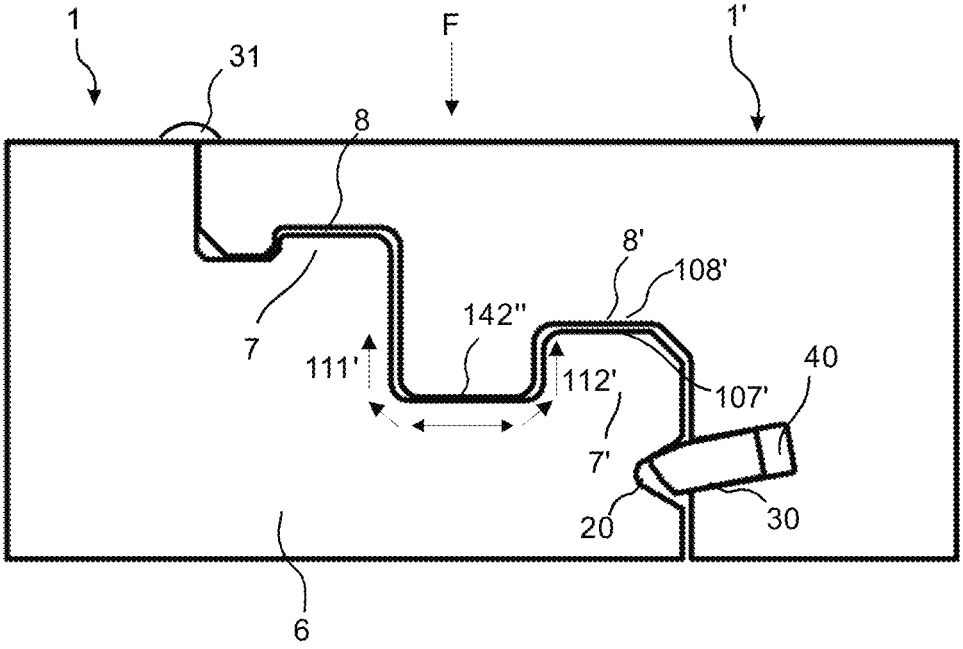

FIGS. 11 and 12 show embodiments preferably comprising the features of the embodiments explained in the above in relation to FIGS. 9A to 10B. In addition to the said features, as shown in FIGS. 11 and 12, an outer part of the strip 6 may comprise a second element 7' and an underside of the third edge may comprise a second element groove 8', wherein the second element 7' and the second element groove 8' may be configured for positioning of the first panel 1' relative the third panel 1 in a horizontal direction.

The joint of FIGS. 11A-12B are configured for a joining of the edge of the first panel 1 and the adjacent edge of the adjacent panel 1' by a vertical motion 113 of the edge relative the adjacent edge as explained in relation e.g. to FIGS. 9A-9B and 10A-10B.

The second element 7' may be configured to cooperate, in a joined position of the edge and the adjacent edge, with the second element groove 8 for positioning of the panel 1 relative the adjacent panel 1' in a first horizontal direction, the second element groove 8' may be configured to receive the second element 7', and the first joint edge 132 is configured to cooperate with the second joint edge 131 for positioning of the panel 1 relative the adjacent panel 1' in a second opposite horizontal direction.

The second element 7' may be positioned vertically below the first element 7.

The second element 7' may be positioned outboard of and vertically below the first element 7.

The displaceable tongue 30 may be positioned vertically between the first element 7 and the second element 7' as shown in FIGS. 11A-11B.

The displaceable tongue 30 may be configured to translate, preferably linearly translate, inside the displacement groove 40 and along a lower surface of the displacement groove 40.

The second element groove 8' may be positioned vertically below the first element groove 8.

The second element groove 8' may be positioned outboard of and vertically below the first element groove 8.

The tongue groove 40 may be positioned vertically between the first element groove 8 and the second element groove 8' in FIGS. 11A-11B.

The displaceable tongue 30 may be positioned outboard a third cooperation area 142" in joint position, as shown in FIGS. 12A-12B.

The lower surface of the displacement groove 40 may be inclined upwards, in a direction towards an opening of the displacement groove 40, in relation to the back surface of the panel, i.e. towards the plane of the upper surface 41, as shown in FIGS. 11A and 12A.

The lower surface of the displacement groove 40 may be inclined downwards, in a direction towards an opening of the displacement groove 40, in relation to the back surface of the panel, i.e. towards the plane of the back surface 42, as shown in FIGS. 11B and 12B.

The displaceable tongue 30 may be positioned at an outermost portion of the strip 6, preferably at a position vertically below the first and second elements 7, 7', as shown in FIG. 12A.

The tongue groove 20 may be positioned at an outermost portion of the strip 6, preferably at a position vertically below the first and second elements 7, 7', as shown in FIG. 12B.

The provision of a second element 7' and a second element groove 8' may facilitate improved resistance to relative rotation between the panel 1 and the adjacent panel 1', such as bending of the joint, in response to a vertical force F applied to the joint and/or the first panel 1 and/or the adjacent panel 1'. A joint with improved resistance to water penetration may thus be achieved.

The displaceable tongue 30 may be arranged in the edge comprising the first and second elements 7, 7' as shown in FIGS. 11A and 12A or in the edge comprising the first and second element groove 8, 8' as shown in FIGS. 11B and 12B. Thus, in the embodiments shown in FIGS. 11B and 12B, the displaceable tongue 30 is configured in the second joint edge 131 of the falling panel, i.e. the adjacent panel 1' configured to make the said vertical motion in relation to the first joint edge 132 of panel 1.

A second element top surface 107' of the second element 7' may be configured to cooperate, in the joined position, with a second groove top surface 108' of the second locking groove 8 for positioning of the panel 1 relative the adjacent panel 1' in a second vertical direction.

A third cooperation area 142" is formed, in the joined position, between the second element top surface 107' and the second groove top surface 108'.

The third cooperation area 142" above the strip 6 and between the second element 7' and the first element 7 may be configured to be filled partly or completely with a glue before the edge and the adjacent edge are joined, the second element top surface 107' of the second element 7' may be configured to cooperate, in the joined position, with a second groove top surface 108' of the second locking groove 8 to displace the glue in the joint towards 111' an upper surface 41 of the panel and towards 112' a lower surface 42 of the panel, for example the second element top surface 107' and the second element groove top surface 108' may be configured to become arranged in close proximity of each other or in abutment with each other in joined position.

The viscosity of the glue may be within the range of about 3000 CP to about 20,000 cP at 20° C., about 5000 to about 15,000 cP at 20° C. or is about 10,000 cP at 20° C.

The glue may include one or more of Poly vinyl acetate glue, MS polymer glue, Polyurethane glue, Urea-formaldehyde glue, silicone or thermoplastic rubber.

A second element side surface 103' of the second element 7' may be configured to cooperate with a second element groove side surface 104' for positioning of the panel 1 relative the adjacent panel 1' in the first horizontal direction, wherein the second element side surface 103' and second element groove side surface 104' may be configured to adapt the amount of glue displaced towards the outer part of the strip 6.

When the word "about" or "essentially" is used in this specification in connection with a numerical value, it is intended that the associated numerical value include a tolerance of +/−10% around the stated numerical value.

Items

Item 1.

A set of essentially identical subfloor panels 1, 1', 1" comprising a joint configured to be glued, wherein the joint comprises a strip 6 which protrudes from a first joint edge 132 at an edge of a panel 1, wherein the joint comprises an element groove 8 at an underside of an adjacent edge of an adjacent panel 1' and adjacent a second joint edge 131 of the adjacent edge, wherein the strip 6 comprise an element 7 which is configured to cooperate, in a joined position of the edge and the adjacent edge, with the element groove 8 for positioning of the panel 1 relative the adjacent panel 1' in a first horizontal direction and the first joint edge 132 is configured to cooperate with the second joint edge 131 for positioning of the panel 1 relative the adjacent panel 1' in a second opposite horizontal direction, wherein the joint comprises a flexible tongue 30 at an outer part of the strip 6 and a tongue groove 20 below the element groove 8 or a flexible tongue 30 below the element groove 8 and a tongue groove 20 at an outer part of the strip 6, wherein the flexible tongue 30 is configured to cooperate, in the joined position, with the tongue groove 20 for positioning of the panel 1 relative the adjacent panel 1' in a first vertical direction, wherein the joint is configured for a joining of the edge and the adjacent edge by a vertical motion 113 of the edge relative the adjacent edge, wherein a space above the strip 6 and between the element 7 and the first joint edge 132 is configured to be filled partly or completely with a glue before the edge and the adjacent edge are joined, and wherein the joint is configured such that during joining the glue is displaced in the joint and towards an upper surface 41 of the panel and towards a lower surface 42 of the panel, and wherein a flow resistance towards the lower surface 42 is larger than a flow resistance towards the upper surface 41.

Item 2.

The set as in item 1, wherein an element top surface 107 of the element 7 is configured to cooperate, in the joined position, with a groove top surface 108 of the locking groove 8 for positioning of the panel 1 relative the adjacent panel 1' in a second vertical direction.

Item 3.

The set as in item 1 or 2, wherein a first upper joint edge surface 102 of the first joint edge 132 is configured to cooperate, in the joined position, with a second upper joint edge surface 101 of the second joint edge 131 for positioning of the panel 1 relative the adjacent panel 1' in a second opposite horizontal direction.

Item 4.

The set as in item 3, wherein, in the joined position, a third distance 115 between the first upper joint edge surface 102 and the second upper joint edge surface 101 is in the range of about 0.05 mm to about 0.3 mm, or in the range of about 0.1 mm to about 0.2 mm, or is about 0.15 mm.

Item 5.

The set as in item 3 or 4, wherein the first joint edge 132 comprises third lower joint edge surface 122, which is adjacent and below the first upper joint edge surface 102 and the second joint edge 131 comprises a fourth lower joint edge surface 121, which is adjacent and below the second upper joint edge surface 101, wherein a fourth distance 117, in the joined position, between the third lower joint edge surface 122 and fourth lower joint edge surface 121, is greater than the third distance 115.

Item 6.

The set as in any one of the preceding items 2-5, wherein a cooperation area, in the joined position, between element top surface 107 and the groove top surface 108 extends over a first distance 106 and a cooperation area between the first upper joint edge surface 102 and the second upper joint edge surface 101 extends over a second distance 105, wherein the first distance 106 is greater than the second distance 105.

Item 7.

The set as in any one of the preceding items, wherein an element side surface 103 of the element 7 is configured to cooperate with an element groove side surface 104 for positioning of the panel 1 relative the adjacent panel 1' in the first horizontal direction, wherein the element side surface 103 and element groove side surface 104 are configured to prevent or reduce the amount of glue displaced towards the outer part of the strip 6.

Item 8.

The set as in any one of the preceding items, wherein the viscosity of the glue is within the range of about 3000 CP to about 20,000 cP at 20° C., about 5000 to about 15,000 cP at 20° C. or is about 10,000 cP at 20° C.

Item 9.

The set as in any one of the preceding items, wherein the joint comprises a lower surface 119 adjacent the element groove 8 which is configured to be positioned, in a joined position, at a fifth distance 116 from an upper surface 120 of the strip 6, wherein the fifth distance preferably is in the range of about 0.2 mm to about 0.5 mm or preferably is about 0.3 mm Item 10.

The set as in any one of the preceding items, wherein the glue includes one or more of Poly vinyl acetate glue, MS polymer glue, Polyurethane glue, Urea-formaldehyde glue, silicone or thermoplastic rubber.

Item 11.

The set as in any one of the preceding items, wherein the panel 1 and the adjacent panel 1' are wood based panels, such as particleboard, OSB, plywood, HDF or MDF.

Item 12.

The set as in any one of the preceding items, wherein an outer part of the strip 6 comprises a second element 7' and an underside of the third edge 4*a* of the adjacent panel 1' comprises a second element groove 8', preferably the second element 7' and the second element groove 8' are configured for positioning of the first panel 1' relative the adjacent panel (1) in a horizontal direction.

Item 13.

The set as in item 12, wherein a third cooperation area 142" is formed above the strip 6 and between the second element 7' and the first element 7.

Item 14.

The set as in item 13, wherein the third cooperation area 142" is configured to be filled partly or completely with a glue before the edge and the adjacent edge are joined.

Item 15.

The set as in any one of the preceding items 12 to 14, wherein the second element top surface 107' of the second element 7' is configured to cooperate, in the joined position, with a second groove top surface 108' of the second locking groove 8 to displace the glue in the joint towards 111' an upper surface 41 of the panel and towards 112' a lower surface 42 of the panel.

The invention claimed is:

1. A set of essentially identical subfloor panels comprising a joint configured to be glued, wherein the joint comprises a strip which protrudes from a first joint edge at an edge of a panel, wherein the joint comprises an element groove at an underside of an adjacent edge of an adjacent panel and adjacent a second joint edge of the adjacent edge, wherein the strip comprise an element which is configured to cooperate, in a joined position of the edge and the adjacent edge, with the element groove for positioning of the panel relative to the adjacent panel in a first horizontal direction and the first joint edge is configured to cooperate with the second joint edge for positioning of the panel relative to the adjacent panel in a second opposite horizontal direction, wherein the joint comprises a flexible tongue at an outer part of the strip and a tongue groove below the element groove or a flexible tongue below the element groove and a tongue groove at an outer part of the strip, wherein the flexible tongue is configured to cooperate, in the joined position, with the tongue groove for positioning of the panel relative to the adjacent panel in a first vertical direction, wherein the joint is configured for a joining of the edge and the adjacent edge by a vertical motion of the edge relative to the adjacent edge, wherein a first space above the strip and between the element and the first joint edge is configured to be filled partly or completely with a glue before the edge and the adjacent edge are joined, and wherein the joint is configured such that during joining the glue is displaced in the joint and towards an upper surface of the panel and towards a lower surface of the panel, and wherein a flow resistance towards the lower surface is larger than a flow resistance towards the upper surface, wherein the joint comprises a lower surface adjacent the element groove which is configured to be positioned, in the joined position, at a fifth distance from an upper surface of the strip such that there is a second space extending between the first space and the element.

2. The set as claimed in claim 1, wherein a first upper joint edge surface of the first joint edge is configured to cooperate, in the joined position, with a second upper joint edge surface of the second joint edge for positioning of the panel relative to the adjacent panel in a second opposite horizontal direction.

3. The set as claimed in claim 2, wherein, in the joined position, a third distance between the first upper joint edge surface and the second upper joint edge surface is in the range of about 0.05 mm to about 0.3 mm.

4. The set as claimed in claim 3, wherein the first joint edge comprises a third lower joint edge surface, which is adjacent and below the first upper joint edge surface and the second joint edge comprises a fourth lower joint edge surface, which is adjacent and below the second upper joint edge surface, wherein a fourth distance, in the joined position, between the third lower joint edge surface and fourth lower joint edge surface, is greater than the third distance.

5. The set as claimed in claim 1, wherein a first area of contact, in the joined position between the element top surface and the groove top surface extends over a first distance, and wherein a second area of contact between the first upper joint edge surface and the second upper joint edge surface extends over a second distance, wherein the first distance is greater than the second distance.

6. The set as claimed in claim 1, wherein an element side surface of the element is configured to cooperate with an element groove side surface for positioning of the panel relative to the adjacent panel in the first horizontal direction, wherein the element side surface and element groove side surface are configured to prevent or reduce the amount of glue displaced towards the outer part of the strip.

7. The set as claimed in claim 1, wherein the viscosity of the glue is within the range of about 3000 cP to about 20,000 cP at 20 C°.

8. The set as claimed in claim 1, wherein the glue includes one or more of Poly vinyl acetate glue, MS polymer glue, Polyurethane glue, Urea-formaldehyde glue, silicone or thermoplastic rubber.

9. The set as claimed in claim 1, wherein the panel and the adjacent panel are wood based panels.

10. The set as claimed in claim 1, wherein an outer part of the strip comprises a second element and an underside of the edge of the adjacent panel comprises a second element groove.

11. The set as claimed in claim 10, wherein a third cooperation area is formed above the strip and between the second element and the first element.

12. The set as claimed in claim 11, wherein the third cooperation area is configured to be filled partly or completely with a glue before the edge and the adjacent edge are joined.

13. The set as claimed in claim 10, wherein a second element top surface of the second element is configured to cooperate, in the joined position, with a second groove top surface of the second element groove to displace the glue in the joint towards an upper surface of the panel and towards a lower surface of the panel.

14. The set as claimed in claim 1, wherein the fifth distance is in the range of about 0.2 mm to about 0.5 mm.

15. The set as claimed in claim 9, wherein the wood based panels include particleboard, OSB, plywood, HDF or MDF.

16. The set as claimed in claim 10, wherein the second element and the second element groove are configured for positioning of the adjacent panel relative to the panel in a horizontal direction.

17. The set as claimed in claim 1, wherein an element top surface of the element is configured to contact, in the joined position, a groove top surface of the locking groove for positioning of the panel relative to the adjacent panel in a second vertical direction.

* * * * *